US006964608B1

(12) United States Patent
Koza

(10) Patent No.: US 6,964,608 B1
(45) Date of Patent: Nov. 15, 2005

(54) SKILL GAMES

(75) Inventor: John R. Koza, 25372 La Rena La., Los Altos Hills, CA (US) 94022

(73) Assignee: John R. Koza, Los Altos Hills, CA (US)

( * ) Notice: Subject to any disclaimer, the term of this patent is extended or adjusted under 35 U.S.C. 154(b) by 98 days.

(21) Appl. No.: 09/690,923

(22) Filed: Oct. 17, 2000

Related U.S. Application Data

(63) Continuation-in-part of application No. 09/524,857, filed on Mar. 14, 2000.

(51) Int. Cl.[7] ..... A63F 9/24

(52) U.S. Cl. ..... 463/9; 379/93.13; 340/323 R; 700/92

(58) Field of Search ..... 463/1, 9–13, 16, 463/25, 29, 40–42; 273/440–441, 236–237, 429–432, 269, 459–461, 274; 434/118, 322, 323, 307 R; 380/251, 255, 258; 340/323 R, 5.1, 5.2; 379/93.01–93.02, 93.13

(56) References Cited

U.S. PATENT DOCUMENTS

| | | | |
|---|---|---|---|
| 4,586,707 A | | 5/1986 | McNeight et al. |
| 4,593,904 A | | 6/1986 | Graves |
| 4,666,160 A | | 5/1987 | Hamilton |
| 4,669,730 A | | 6/1987 | Small |
| 4,756,532 A | | 7/1988 | Kamille |
| 4,926,327 A | | 5/1990 | Sidley |
| 4,964,642 A | | 10/1990 | Kamille |
| 5,038,022 A | | 8/1991 | Lucero |
| 5,083,271 A | | 1/1992 | Thacher et al. |
| 5,092,598 A | | 3/1992 | Kamille |
| 5,094,458 A | | 3/1992 | Kamille |
| 5,114,155 A | | 5/1992 | Tillery et al. |
| 5,420,830 A | | 5/1995 | Camaratta, Jr. et al. |
| 5,429,361 A | | 7/1995 | Raven et al. |
| 5,454,570 A | | 10/1995 | Karal |
| 5,513,117 A | | 4/1996 | Small |
| 5,518,249 A | | 5/1996 | Sines et al. |
| 5,544,892 A | | 8/1996 | Breeding |
| 5,546,523 A | | 8/1996 | Gatto |
| 5,549,300 A | | 8/1996 | Sardarian |
| 5,566,946 A | | 10/1996 | Parker |
| 5,593,349 A | | 1/1997 | Miguel et al. |
| 5,630,753 A | * | 5/1997 | Fuchs |
| 5,643,088 A | | 7/1997 | Vaughn et al. |
| 5,649,705 A | | 7/1997 | String |
| 5,660,391 A | | 8/1997 | Klasee |

(Continued)

FOREIGN PATENT DOCUMENTS

| | | |
|---|---|---|
| WO | WO 94/27921 | 5/1994 |
| WO | WO 97/19537 | 1/1996 |
| WO | WO 98/00210 | 6/1997 |

*Primary Examiner*—Mark Sager
(74) *Attorney, Agent, or Firm*—Blakely, Sokoloff, Taylor & Zafman LLP

(57) ABSTRACT

Skill games are described that are implemented using network communications. The subject matter of the present invention concerns games of skill that are legal, under current law, in most states of the United States and in many jurisdictions of other countries and the game includes a mechanism for determining if a player is eligible.

38 Claims, 34 Drawing Sheets

U.S. PATENT DOCUMENTS 5,660,392 A 8/1997 Hansen
5,667,217 A 9/1997 Kelly et al.
5,676,371 A 10/1997 Kelly et al.
5,697,611 A 12/1997 Kelly et al.
5,697,844 A * 12/1997 Von Kohorn
5,700,007 A 12/1997 Kelly et al.
5,704,612 A 1/1998 Kelly et al.
5,733,193 A 3/1998 Allard et al.
5,743,523 A 4/1998 Kelly et al.
5,743,532 A 4/1998 Lafferty
5,755,621 A 5/1998 Marks et al.
5,768,382 A 6/1998 Schneier et al.
5,769,424 A 6/1998 Kelly et al.
5,803,451 A 9/1998 Kelly et al.
5,816,918 A 10/1998 Kelly et al.
5,836,586 A 11/1998 Marks et al.
5,855,514 A 1/1999 Kamille
5,860,648 A 1/1999 Petermeier et al.
5,882,258 A 3/1999 Kelly et al.
5,888,115 A 3/1999 Shoemaker, Jr. et al.
5,902,983 A 5/1999 Crevelt et al.
5,921,864 A * 7/1999 Walker
5,931,467 A 8/1999 Kamille
5,944,316 A 8/1999 Hernandez
5,967,514 A 10/1999 Kelly et al.
5,970,143 A 10/1999 Schneier et al.
5,996,997 A 12/1999 Kamille
6,007,426 A 12/1999 Kelly et al.
6,012,722 A 1/2000 Petermeier et al.
6,015,344 A 1/2000 Kelly et al.
6,019,374 A 2/2000 Breeding
6,024,640 A 2/2000 Walker et al.
6,048,271 A 4/2000 Barcelou
6,174,237 B1 1/2001 Stephenson

* cited by examiner

The Presidents Game
[300] Game Number 123456

[310] Hints:
1. President who served non-consecutive terms
2. President who was elected to Senate after being president
3. President who was in railway accident on his way to his inauguration in which his son was killed
4. President elected by the House of Representatives after failing to receive a majority of the electoral votes
5. First president to travel outside the United states while still in office
6. First president to be photographed while in office

[320]
☐ George Washington
☐ John Adams
☐ Thomas Jefferson
☐ James Madison
☐ James Monroe
☐ John Quincy Adams
☐ Andrew Jackson
☐ Martin Van Buren
☐ William Henry Harrison
☐ John Tyler
☐ James K. Polk
☐ Zachery Taylor
☐ Millard Fillmore
☐ Franklin Pierce
☐ James Buchanan
☐ Abraham Lincoln
☐ Andrew Johnson
☐ Ulysses S. Grant
☐ Ruthford Hayes
☐ James A. Garfield
☐ Chester A. Arthur
☐ Grover Cleveland
☐ Benjamin Harrison
☐ William McKinley
☐ Theodore Roosevelt
☐ William H. Taft

FIG. 3A

- ☐ Woodrow Wilson
- ☐ Warren G. Harding
- ☐ Calvin Coolidge
- ☐ Herbert Hoover
- ☐ Franklin Roosevelt
- ☐ Harry S. Truman
- ☐ Dwight D. Eisenhower
- ☐ John F. Kennedy
- ☐ Lyndon Johnson
- ☐ Richard Nixon
- ☐ Gerald Ford
- ☐ Jimmy Carter
- ☐ Ronald Reagan
- ☐ George Bush
- ☐ William Clinton

[330]

Click here to submit your answers

[340] Ending time: 18:15:00 PST

[350]

Click here for official time

[360]

Click here for rules

FIG. 3B

The History Game
[400] Game Number 1234567

[410] Hints:
1. Date of the Battle of Waterloo
2. Date of completion of the transcontinental railroad in Canada
3. Month when the state from which the greatest number of presidents have been elected was admitted to the United States

[420]

| Query 1 | Query 2 | Query 3 |
|---|---|---|
| ☐ January | ☐ January | ☐ January |
| ☐ February | ☐ February | ☐ February |
| ☐ March | ☐ March | ☐ March |
| ☐ April | ☐ April | ☐ April |
| ☐ May | ☐ May | ☐ May |
| ☐ June | ☐ June | ☐ June |
| ☐ July | ☐ July | ☐ July |
| ☐ August | ☐ August | ☐ August |
| ☐ September | ☐ September | ☐ September |
| ☐ October | ☐ October | ☐ October |
| ☐ November | ☐ November | ☐ November |
| ☐ December | ☐ December | ☐ December |

Click here to submit your answers

Ending time: 18:15:00 PST

Click here for official time

Click here for rules

FIG. 4

The Decades Game
[500] Game Number 123458

[510] Questions:
1. In what decade was the first non-stop transcontinental airplane flight made in Australia?
2. In what decade was the Luisitania sunk?

- ☐ 1900 - 1909
- ☐ 1910 - 1919
- ☐ 1920 - 1929
- ☐ 1930 - 1939
- ☐ 1940 - 1949
- ☐ 1950 - 1959
- ☐ 1960 - 1969
- ☐ 1970 - 1979
- ☐ 1980 - 1989
- ☐ 1990 - 1999

Click here to submit your answers

Ending time: 18:15:00 PST

Click here for official time

Click here for rules

FIG. 5

Crossword Geography Game
[600]Game Number 123459

[610]Hints:
2-Across - 22nd state to be admitted to the Union
3-Across - Capital of Bulgaria
7-Across - Northern California city
2-Down - U.S. state purchased from another country
3-Down - Major European city and a county seat in Texas
5-Down - Leading agricultural U.S. state

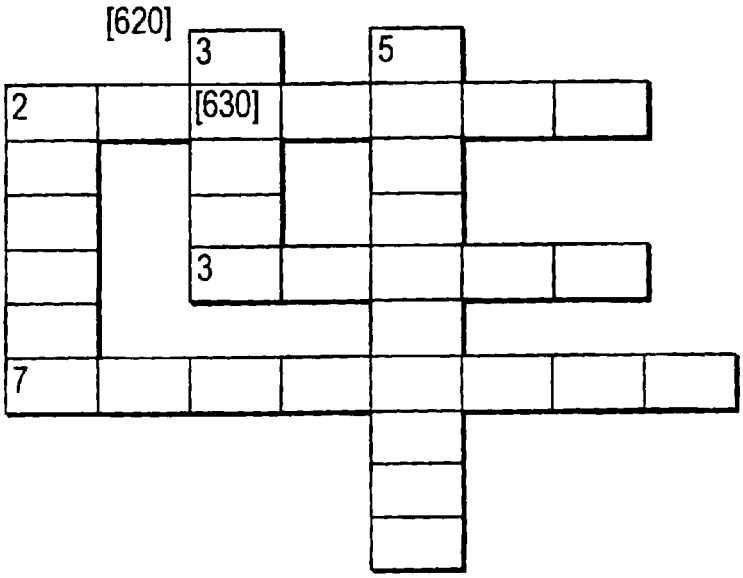

Click here to submit your answers

Ending time: 18:15:00 PST

Click here for official time

Click here for rules

FIG. 6

Solution to Game Number 123459

The Letter Reallocation Game (using each letter of the Starting Word exactly once)

[800] Game Word: 123460

[810] Starting Word: STEAK

[820]

| | | | | |
|---|---|---|---|---|
| | | | | |
| | | | | |
| | | | | |
| | | | | |
| | | | | |
| | | | | |
| | | | | |

Click here to submit your answers

Ending time: 18:15:00 PST

Click here for official time

Click here for rules

FIG. 8

The Letter Reallocation Game (with each letter of the Starting Word usable zero, one, or more times)

[900] Game Number: 123461

[910] Starting Word: ARITHMETIC

[920]

_____

_____

_____

_____

_____

_____

_____

Click here to submit your answers

Ending time: 18:15:00 PST

Click here for official time

Click here for rules

FIG. 9

The Days of the Week Game

[1000] Game Number: 123462

[1010] Hints:

1. Day when Charles Lindburgh arrived in Paris after his transatlantic solo flight
2. Day when Japanese attacked Pearl Harbor

- ☐ Monday
- ☐ Tuesday
- ☐ Wednesday
- ☐ Thursday
- ☐ Friday
- ☐ Saturday
- ☐ Sunday Click here to submit your answers Ending time: 18:15:00 PST Click here for official time Click here for rules

FIG. 10

Illustrative Communication Path on the Internet from Los Altos, California to San Diego, California Names of Servers in one Illustrative Communication Path on the Internet between Los Altos, California and San Diego, California First Name Game

[1300] Game Number: 123463

[1310] Hints:
1. Lead actor in the movie Stagecoach
2. King of England who gave up his throne for woman he loved

[1320]

- ☐ Adam
- ☐ Charles
- ☐ Donald
- ☐ Edward
- ☐ Frank
- ☐ George
- ☐ Henry
- ☐ John
- ☐ Louis
- ☐ Michael
- ☐ Paul
- ☐ Richard

[1330]

Click here to submit your answers

Ending time: 18:15:00 PST

Click here for official time

Click here for rules

FIG. 13

The Traveling Salesman Game

[1400] Game Number: 123464

[1410]

[1415]

Click here to delete last segment

[1418]

Click here to start anew

[1420]

Click here to submit your answer

Ending time: 18:15:00 PST

Click here for official time

Click here for rules

The Jigsaw Game

[1600] Game Number: 123465

[1610]

[1620]

Click here to submit your answer

Ending time: 18:15:00 PST

Click here for official time

Click here for rules

The Hamiltonian Path Game

[1800] Game Number: 123465

[1810]

[1815]

Click here to delete last segment

[1818]

Click here to start anew

[1820]

Click here to submit your answer

Ending time: 18:15:00 PST

Click here for official time

Click here for rules

The Knapsack Game

[2200] Game Number: 123467

[2206]
Maximum allowed weight: 10 pounds

[2208]
Total weight so far: 0 pounds

[2209]
Total value so far: $0

[2218]

Click here to start anew

[2220]

Submit

Ending time: 18:15:00 PST

Click here for official time

Click here for rules

MENU [2300]

| 2310 | 2320 | 2330 | 2340 | 2350 | 2360 | 2370 | 2380 | 2390 | 2395 |
|---|---|---|---|---|---|---|---|---|---|
| ☐ 2311 | First Name Game | $1 | $10 | Rules [2351] | Sample [2361] | 5 min | 1,234 winners [2381] | 1 waiting | 2 needed |
| ☐ 2312 | Crossword Geography | $1 | $5 | Rules | Sample | 5 min | 3,156 winners | 0 waiting [2392] | 2 needed |
| ☐ 2313 | Bin Packing | $1 | $20 | Rules | Sample | 10 min | 2,889 winners | 0 waiting [2393] | 2 needed |
| ☐ 2314 | Traveling Salesman | $1 | $25 | Rules | Sample | 10 min [2374] | 1,759 winners | 1 waiting [2394] | 2 needed [2399] |

FIG. 23

MENU [2400]

[2401]

| | | | | | | | | | |
|---|---|---|---|---|---|---|---|---|---|
| ☐ 2411 | Decades Game 2421 | $1 2431 | $2 2441 | Rules | Sample | 5 min 2471 | 2,344 winners 2479 | 1 waiting 2481 | 3 needed 2491 |
| ☐ 2412 | Presidents Game 2422 | $2 2432 | $5 2442 | Rules | Sample | 5 min | 3,156 winners | 1 waiting 2482 | 3 needed 2492 |
| ☐ 2413 | Knapsack Game 2423 | $1 2433 | $2 2443 | Rules | Sample | 5 min | 2,889 winners | 1 waiting 2483 | 3 needed 2493 |
| ☐ 2414 | Hamiltonian Path 2424 | $2 2434 | $5 2444 | Rules | Sample | 5 min | 1,759 winners | 1 waiting 2484 | 3 needed 2494 |

[2405]

| | | | | | | | | |
|---|---|---|---|---|---|---|---|---|
| ☐ 2415 | Months Game 2425 | $1 2435 | $10 2445 | Rules | Sample | 10 min 2475 | 1,045 winners | Noon Monday 2485 |
| ☐ 2416 | Traveling Salesman Game 2426 | $2 2436 | $10 2446 | Rules | Sample | 10 min | 1,479 winners | Noon Tuesday |

[2407]

| | | | | | | | | |
|---|---|---|---|---|---|---|---|---|
| ☐ 2417 | States Game 2427 | $1 2437 | $25 2447 | Rules | Sample | 24 hours 2477 | 1,548 winners | Noon Friday |

FIG. 24

Flashcard Trivia Game (Single four-alternative query) 2500
Game Number 123456 2501
Time remaining 40 2502

Picture of Panama Canal 2505

2510 First president to travel outside the United States while in office

- ☐ William McKinley 2511
- ☐ Theodore Roosevelt 2512
- ☐ William H. Taft 2513
- ☐ Woodrow Wilson 2514

2530

Submit

Figure 26

Multi-Question Trivia Game (Multiple 4-alternative queries) 2600

Game Number 123456

Time remaining 40

Picture of 100th anniversary of baseball 2605

2610

First president to travel outside the United States while still in office

- ☐ William McKinley 2611
- ☐ Theodore Roosevelt 2612
- ☐ William H. Taft 2613
- ☐ Woodrow Wilson 2614

2620

President during the 100th anniversary of baseball

- ☐ Franklin Roosevelt 2621
- ☐ Theodore Roosevelt 2622
- ☐ Harry Truman 2623
- ☐ Woodrow Wilson 2624

Submit

Figure 27

Lotto Trivia Game (Alternatives shared on common by all queries) 2700

Game Number 123456

Time remaining 40

| Picture of Confederate paper money **2705** |
|---|

1. The empire state 2711
2. State where confederacy had its capital 2712

2720

- ☐ Alabama 2721
- ☐ Alaska 2722
- ☐ Florida 2723
- ☐ Georgia 2724
- ☐ Hawaii 2725
- ☐ Mississippi 2726
- ☐ New York 2727
- ☐ Virginia 2728

| Submit |
|---|

Crossword Game 2800
Game Number 123456
Time remaining 40

Picture of downtown Atlanta with gold-domed state capital 2805

6- Down - State with gold rush in 1848 2811
(10 points) 2816

2-Across - State with Klondike gold rush 2812
(20 points) 2817

6-Across - Southern state with a gold rush 2813
(40 points) 2818

2820

Submit

Figure 29

Letter Rearrangement Game 2900
Game Number 123456
Time remaining 40

Picture of mouth 2905

Starting with 2910

| | | | | | |
|---|---|---|---|---|---|
| H | T | T | O | R | A |

2920

| | | | | | |
|---|---|---|---|---|---|
| | | | | | |

Submit

Figure 30

Word Construction Game 3000
Game Number 123456
Time remaining 40

Picture of steam railroad locomotive 3005

3010 Starting with

| | | | | |
|---|---|---|---|---|
| M | E | A | T | S |

3020

| | | | | |
|---|---|---|---|---|
| | | | | |
| | | | | |
| | | | | |
| | | | | |
| | | | | |
| | | | | |
| | | | | |

Submit

Figure 31

Bin Trivia Game (with individual elements to be dragged and dropped into bins) 3100
Game Number 123456
Time remaining 40

Picture of Sun Micro Systems corporate logo 3105

Franklin Pierce 3111

Charles Bronson 3112

William Gates 3113

James Polk 3114

Scott McNeely 3115

George Scott 3116

President 3131

Picture of White House 3132

Famous movie Star 3141

Picture of Hollywood sign on side of hill 3142

Famous businessman 3151

Picture of office building 3152

Submit

Figure 32

True/False Trivia Game 3200

Game Number 123456
Time remaining 15

| Satellite picture of Millennium Dome in London 3205 |
|---|

3210
This building is in the United States

☐ True 3211
☐ False 3212

| Submit |
|---|

Figure 33

Flashcard Trivia Game (Single four-alternative query) 3300

Game Number 123456
Time remaining 15 3308

3310 First president to travel outside the United States while in office
(This question is worth 10 points) 3311

| Click here for clue (costs 5 points) **3305** |
|---|

- ☐ William McKinley 3311
- ☐ Theodore Roosevelt 3312
- ☐ William H. Taft 3313
- ☐ Woodrow Wilson 3314

| Submit |
|---|

SKILL GAMES

This application is a continuation-in-part of co-pending U.S. patent application Ser. No. 09/524,857, entitled "Skill Games," filed Mar. 14, 2000.

FIELD OF THE INVENTION

The present invention relates to the field of skill games; more particularly, the present invention relates to skill games that are implemented using network communications.

BACKGROUND OF THE INVENTION

Various forms of games are well known in the prior art. It is often useful to categorize such games on the basis of whether they possess the attributes of prize, chance, and consideration. First, a game may be categorized on the basis of whether it is played in order to win something of value (a prize) or whether it is played for only amusement purposes. Second, a game may also be categorized on the basis of whether participation is free or whether some valuable consideration is required in order to participate in the game. Third, a game may be further categorized on the basis of whether it involves chance or skill.

Games of chance include bingo, casino games (e.g., roulette), promotional giveaway games of chance operated by commercial entities, and games such as lotto games and the rub-off instant lottery game that are operated by most state governments in the United States and various national, provincial, state, and municipal lotteries in other countries.

Games of skill include crossword puzzles, games involving answering questions based on knowledge about specific fields (e.g., history and geography), and games of skill involving more than one player (e.g., checkers or chess).

Subject to certain limited and specific exceptions, it is generally illegal to operate a game involving prize, chance, and consideration in most states of the United States and in most jurisdictions of most other countries. A game involving the attributes of prize, chance, and consideration is often called a "lottery" under the laws of many states of the United States and under the laws of many other countries. Section 319 of chapter 9 of the California code is typical of the laws of many states of the United States and under the laws of many other countries in the way that it defines a lottery as follows:

A lottery is any scheme for the disposal or distribution of property by chance, among persons who have paid or promised to pay any valuable consideration for the chance of obtaining such property or a portion of it, or for any share of any interest in such property, upon any agreement, understanding, or expectation that it is to be distributed or disposed of by lot or chance, whether called a lottery, raffle, or gift-enterprise, or by whatever name the same may be known.

With certain limited exceptions (described below), lotteries are generally deemed to be illegal by the laws of most states of the United States and under the laws of most other countries. For example, except for certain limited and specific exceptions provided by other sections of California law, lotteries as defined in section 319 are illegal in California.

The exceptions to the laws making most lotteries illegal vary considerably by jurisdiction. For example, bingo games clearly involve prize, chance, and consideration (that is, the player pays money in order to buy a chance to win a prize). Nonetheless, many states in the United States exempt bingo games operated by various charitable and religious organizations from their general prohibition on games involving prize, chance, and consideration.

In addition, the lotteries operated by most state governments in the United States and various national, provincial, state, and municipal also clearly involve prize, chance, and consideration. However, these lotteries are not illegal because of specific exemptions in the laws of their respective jurisdictions.

Also, casino games (e.g., roulette) clearly involve prize, chance, and consideration. However, such games are legal when operated in certain regulated environments in certain jurisdictions. For example, there are legal government-licensed casinos in Atlantic City, N.J., but in no other part of New Jersey. Similarly, there are legal riverboat casinos at certain sites in certain states of the United States and there are legal casinos operated on certain Indian lands in the United States. As another example, a limited number of government-licensed casinos operate in London in the United Kingdom.

In contrast, games that do not incorporate all three of the above attributes (that is, prize, chance, and consideration) are generally legal in most jurisdictions (although the legal status of such games varies considerably from jurisdiction to jurisdiction). Thus, in-store promotional games of chance that offer prizes are legal in most states of the United States because participation in the game does not require consideration. Game tickets for such in-store promotional games are typically distributed freely to any store visitor, regardless of whether the visitor makes a purchase in the store. In addition, the operators of such games typically allow anyone to request a game ticket by simply requesting one by mail or telephone. Thus, the player of such a promotional game is not required to purchase the game ticket or to purchase anything else in order to have a chance to win a prize.

Similarly, newspapers and magazines often run promotional games of chance entailing filling out an entry form that appears in the publication. Again, such games are legal in many jurisdictions because they typically give anyone the opportunity to participate in the game merely by making a replica of the entry form or by requesting a free entry form by mail (without purchasing the newspaper or magazine). Also such games are generally legal in many jurisdictions because they do not possess the attribute of consideration.

Similarly, there are numerous games of chance offered on the internet which permit people to play a game of chance in order to win a prize, but require no monetary consideration in order to play. The sites on the internet offering such games typically expose the participant to advertising messages (analogous to the way that an in-store visitor to a store is exposed to various in-store displays enticing, but not requiring, him or her to make a purchase while in the store). These internet games are generally legal in most (or all) jurisdictions in the United States and in many other jurisdictions in other countries because they do not possess all three of the above attributes (that is, prize, chance, and consideration).

Television game shows that offer prizes (whether on the basis of skill alone or a combination of chance and skill) are generally legal because contestants do not pay for the opportunity to participate.

In addition, there are numerous competitions involving skill games (involving, for example, prowess in chess, jigsaw puzzles, golf, bridge, scrabble, and other activities) where the player pays an entry fee in order to participate and in which a prize is offered to the winner of the competition.

Such competitions involving skill have the attributes of both prize and consideration. However, if the game involves involve pure skill (such as chess or a jigsaw puzzle, such as the "Eternity Game" in the United Kingdom offering a prize of 1,000,000 pounds sterling), the game does not have the attribute of chance. Competitions involving games (with prize and consideration) that involve pure skill are generally legal in most states of the United States and in many jurisdictions of other countries.

On the other hand, competitions involving games (with prize and consideration) that involve a mixture of both chance and skill (e.g., draw poker) are legal in far fewer jurisdictions. Many jurisdictions apply a test of whether the activity contains any chance whatsoever and, if it does, the activity is deemed to be illegal. Some jurisdictions apply a test of whether the skill component of the activity predominates over the chance component. The determination of whether the skill component of a particular game predominates over the chance component depends on the application of the legal criteria of the jurisdiction involved and the details of the design of the particular game involved.

The prior art contains certain inventions that combine an ordinary casino game of chance with an additional play step based on skill. For example, U.S. Pat. No. 5,718,429, entitled "Method of Combining a Casino Game with a Game of Skill," issued on Feb. 17, 1998, combines a casino game of chance with a second game based on skill. Winning in such a game first requires success in the casino-style game of chance and then additionally requires success in a game of skill.

Network communication, such as the internet, is well known in the prior art. The use of such network communications for the purpose of commerce (so-called electronic commerce or e-commerce) is also well known. There are numerous internet sites that offer various goods and services for sale. It is common in such internet commerce to accept payment by the use of the buyer's credit card. It is not unusual for such sites to require that a potential buyer provide additional information, such as the billing address of the credit card in addition to the credit card number before processing the sale. It is not unusual that access to most of the pages of an internet site are restricted to persons who have preidentified themselves to the operator of the site by providing, for example, their name, their physical address, demographic information, and their credit card account number.

There are a number of internet casinos in which players pay (typically by credit card) in order to enter a casino-style game of chance (such as roulette) in order to win a prize. These internet casinos are typically located physically in Antigua and other off-shore locations. Such internet casinos typically accept participation from players located in the United States who communicate with the off-shore site by means of the internet. After paying for the opportunity to play, the game of chance is played over the internet for a chance to win a prize. The games offered by such internet casinos possess all three of the attributes of prize, chance, and consideration and would be clearly illegal if conducted inside the United States in the same manner. Most observers believe that such internet casinos are probably illegal in the United States under existing state and federal laws (see Cabot 1999; Sinclair, Schneider, and Balestra 1999) and probably illegal in many jurisdiction of other countries, although this issue has not been adjudicated in the courts to any significant degree as of the time of this writing.

Other Publications

Cabot, Anthony, *The Internet Gambling Report III: An Evolving Conflict Between Technology, Policy, and Law*, Las Vegas, Nev.: Trace Publications, 1999.

Sinclair, Sebastian, Schneider, Sue, and Balestra, Mark, *Wagering on the Internet: Wagering on the Internet*, St. Charles, Mo.: The River City Group, 1999.

Garey, Michael R. and Johnson, David S., *Computers and Intractability: A Guide to the Theory of NP-Completeness*, New York, N.Y.: W. H. Freeman, 1979.

SUMMARY OF THE INVENTION

A skill game and method for playing the same is described. The skill game may include clues (e.g., video, audio, or olfactory clues) that are helpful to the player. In one embodiment, a method comprises establishing communication for enabling communication between a player of a skill game and an operator of the skill game over a networked environment, determining whether the player of the skill game is legally eligible, by virtue of, for example, location and age, to participate in the skill game, preventing the player from participating in the skill game if the player is ineligible, and providing the player with the skill game over the networked environment along with clue information.

Alternatively, a bin trivia game is also described. The formation of groups (tournaments) of players into groups is described based on the player's skill level or player demographics.

Other objects, features, and advantages of the present invention will be apparent from the accompanying drawings and from the detailed description that follows below.

BRIEF DESCRIPTION OF THE DRAWINGS

The present invention will be understood more fully from the detailed description given below and from the accompanying drawings of various embodiments of the invention, which, however, should not be taken to limit the invention to the specific embodiments, but are for explanation and understanding only.

FIG. 3 illustrates a portion of the information on the screen for playing one embodiment of a president's game in which the correct response to each query is a different president.

FIG. 4 illustrates a portion of the information on the screen for playing one embodiment of a game in which the correct response to each query is a month of the year and in which the same month may be the correct answer to more than one query.

FIG. 5 illustrates a portion of the information on the screen for playing one embodiment of a game in which the correct response to each query is a decade and in which in which the correct response to each query is a different decade.

FIG. 6 illustrates a portion of the information on the screen for playing one embodiment of a crossword game in which all the correct responses belong to the category of geographical places.

FIG. 8 illustrates a portion of the information on the screen for playing one embodiment of a game in which a single five-letter starting word is provided, each response is a word composed of all five letters of that word, and each letter of the starting word is used once and only once in creating a response.

FIG. 9 illustrates a portion of the information on the screen for playing one embodiment of a game in which a single starting word is provided, each response is a word composed of some or all letters of that word, and each letter of the starting word may be used zero, one, or more times in creating a response.

FIG. 10 illustrates a portion of the information on the screen for playing one embodiment of a game in which the correct response to each query is one of the seven days of the week and in which the correct response to each query is a different day.

FIG. 13 illustrates a portion of the information on the screen for playing one embodiment of a game in which the correct response to each query is the first name of a person.

FIG. 23 shows a menu presenting information about four illustrative skill games.

FIG. 24 illustrates one embodiment of a menu presenting information about a hierarchical arrangement of skill games.

FIG. 26 illustrates one embodiment of a trivia game with more than one 4-alternative query.

FIG. 27 illustrates one embodiment of a trivia game with alternatives shared on common by all queries.

FIG. 29 illustrates one embodiment of a letter rearrangement game.

FIG. 30 illustrates one embodiment of a word construction game.

FIG. 31 illustrates one embodiment of a bin trivia game with individual elements to be dragged and dropped into bins.

FIG. 32 illustrates one embodiment of a true/false trivia game.

FIG. 33 illustrates a game with a concealed clue that the player can optionally expose.

DETAILED DESCRIPTION OF THE PRESENT INVENTION

Figure 1:
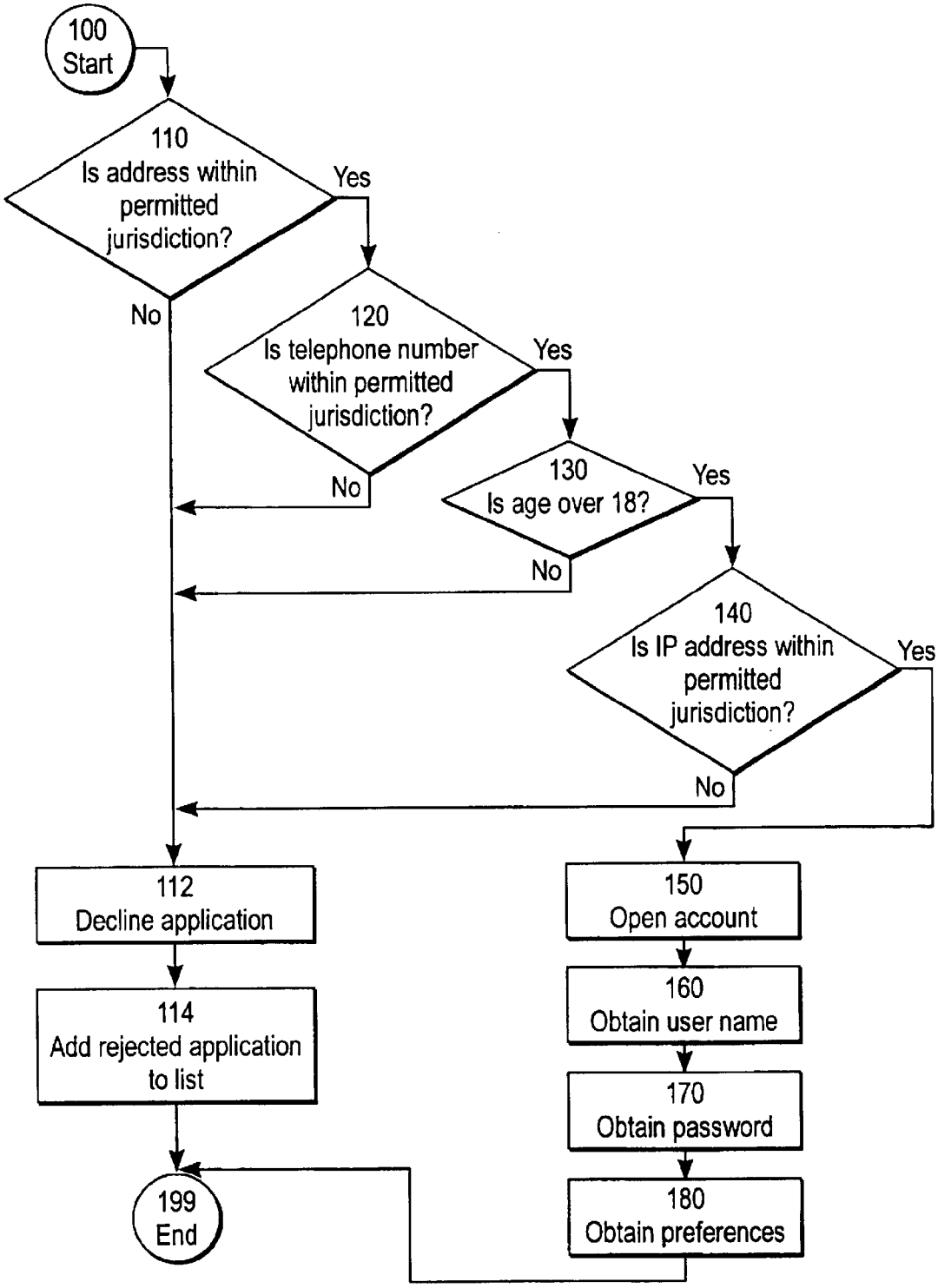
FIG. 1 is a flowchart of one embodiment of a process by which a potential player opens an account.

Skill games are described that are implemented using network communications. It should be emphasized that the subject matter of the present invention concerns games of skill that are clearly legal, under current law, in most states of the United States and in many jurisdictions of other countries.

In the following description, numerous details are set forth. It will be apparent, however, to one skilled in the art, that the present invention may be practiced without these specific details. In other instances, well-known structures and devices are shown in block diagram form, rather than in detail, in order to avoid obscuring the present invention.

Some portions of the detailed descriptions that follow are presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise as apparent from the following discussion, it is appreciated that throughout the description, discussions utilizing terms such as "processing" or "computing" or "calculating" or "determining" or "displaying" or the like, refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission or display devices.

The present invention also relates to apparatus for performing the operations herein. This apparatus may be specially constructed for the required purposes, or it may comprise a general purpose computer selectively activated or reconfigured by a computer program stored in the computer. Such a computer program may be stored in a computer readable storage medium, such as, but is not limited to, any type of disk including floppy disks, optical disks, CD-ROMs, and magnetic-optical disks, read-only memories (ROMs), random access memories (RAMs), EPROMs, EEPROMs, magnetic or optical cards, or any type of media suitable for storing electronic instructions, and each coupled to a computer system bus.

The algorithms and displays presented herein are not inherently related to any particular computer or other apparatus. Various general purpose systems may be used with programs in accordance with the teachings herein, or it may prove convenient to construct more specialized apparatus to perform the required method steps. The required structure for a variety of these systems will appear from the description below. In addition, the present invention is not described with reference to any particular programming language. It will be appreciated that a variety of programming languages may be used to implement the teachings of the invention as described herein.

Network Communications

A skill game is described in which network communication allows a potential player of the skill game to communicate with an operator of the skill game. The network communication is described herein in terms of the internet, although other network communication mechanisms may be used.

In one embodiment, a potential player initiates contact with the operator of the skill game by the use of the internet and is presented with a web page (e.g., a home page) and potentially additional pages of an internet site that describes the skill game and the eligibility requirements for entering the skill game. In one embodiment, access to the remainder of the pages of the internet site are restricted to persons who have previously identified themselves to the operator of the skill game and have successfully opened an account.

In one embodiment, a potential player interested in opening an account provides the operator of the site with his or her name, age, physical address, telephone number, and electronic mail (e-mail) address. In one embodiment, the state and country of the address are entered by the use of menus listing all the states or provinces of each country. All requested information is required before the operator of the site considers the eligibility of the potential player. When the player has provided the requested information, the information is processed by the operator of the site.

FIG. 1 is a flow diagram of one embodiment of a process for opening an account, where such is representative, much like a prerequisite, to playing a skill game. The process is performed through the use of processing logic that may comprise hardware (e.g., dedicated logic, circuitry, etc.), software (such as is run on a general purpose computer system or a dedicated machine), or a combination of both. In general, players of the skill game is located in a jurisdiction where the skill game of the type being offered is legal. The processing logic may be located, at least in part, at the location of the operator of the skill game.

Referring to FIG. 1, the process begins by processing logic checking the physical address entered by the user to determine if it is in a permitted jurisdiction (processing block 110). If the physical address is not within such a jurisdiction, processing logic declines the proffered account (processing block 112). In that event, in one embodiment, processing logic may advise the potential player that he or she is not eligible to participate, the account is not opened, and the processing logic prevents the potential player from gaining access to the remainder of the site.

In one embodiment, processing logic retains the information about the declination of the potential player and adds the potential player to a list, which is stored (processing block 114). Information on the list of declined applications is compared with information contained in all future applications. If a subsequent application is made (particularly if made soon after the first application by apparently the same potential player, but with slightly different information), the new application may be declined on the assumption that the information that was first provided is more likely to be accurate.

If the address is in a permitted jurisdiction, processing logic checks the telephone number to determine if it is in a permitted jurisdiction (processing block 120). If the telephone number is not within such a jurisdiction, processing logic declines the proffered account (processing block 112). As described above, in one embodiment, in declining the proffered account, processing logic advises the potential player that he or she is not eligible to participate, does not open the account, and does not provide the potential player with access to the remainder of the site.

In one embodiment, players of the skill game must be of a legal age (e.g., at least age 18). In such a case, the process of opening an account also includes processing logic requesting the age of the individual and testing whether the individual is at least the legal age (e.g., 18)(processing block 130). If the potential player is not of legal age, the proffered account is declined (at the point labeled 112 in FIG. 1). As discussed above, processing logic advises the potential player that he or she is not eligible to participate, does not open the account, and does not provide the potential player with access to the remainder of the site.

If the individual is of legal age, processing logic determines if the IP address is within the permitted jurisdiction (processing block 140). In this manner, the processing logic considers the latitude and longitude of the internet service provider (or server directly connected to the internet) that originated the communication to the operator of the skill game. The geographic location (e.g., street address, city, as well as the latitude and longitude) of internet service providers and each server directly connected to the internet are generally known and are part of the public database of information about the internet. Thus, it is possible to determine whether such internet service provider or server is within a permitted jurisdiction.

The operator of the site generally relies on the correctness of the information asserted by potential players. However, in one embodiment, the asserted information is also tested for internal consistency. In one embodiment, the process of opening an account includes processing logic determining the location of the telephone number of the proffered account to determine if it is consistent with the physical address of the proffered account. For example, the area code of the telephone number indicates the portion of a state of the United States (or province of Canada or state of Australia) in which the telephone is located. The next three digits of the telephone number generally indicate the particular local area in which the telephone is located.

Similarly, in another embodiment, the asserted information concerning the physical location of the potential player is further tested by processing logic for internal consistency with respect to the latitude and longitude of the machine or internet service provider that originated the communication to the operator of the skill game.

In one embodiment, in addition to relying on the information provided by the potential player and to checking that information for internal consistency, the address of a potential player and the age of a potential player is independently checked, using processing logic, against the address and age contained in records held by the issuer of a credit card being used. It is advantageous to rapidly perform this additional checking, using network communications and processing logic, at the same time that the application of the potential player is being processed.

If the application of the potential player is accepted, processing logic assigns and opens an account (processing block 150). The opening of an account may include the issuance of an account number. Processing logic obtains an individual user name selected by the account holder for the account (processing block 160) and obtains a password selected by the account holder for the account (processing block 170).

At the time of opening an account, processing logic may receive certain preferences established by an account holder regarding the handling of the account (processing block 180). An account holder may subsequently modify these preferences at any later time when logged on to the account. In one embodiment, these preferences include specifying whether the player wants to receive a monthly statement of his account balance by, for example, e-mail and whether the player wants to receive announcements by, for example, e-mail of new games available at the site.

Once a player has opened an account, he may then log on to his account at any time. In one embodiment, when the player logs on to his account, he is presented with information about the current balance in his account. Initially, the player's account has a zero balance. In one embodiment, a player may add money to his account using a credit card. If a player desires to add money to his account using a credit card, he enters the card number, expiration date, and, in one embodiment, the billing address of the credit card. The site attempts to validate the proffered credit card transaction (using techniques that are well known in the art), and, if validated, adds the selected amount of money to the player's account. A player may also add money to his account by sending a check to the operator of the site. In that event, the operator cashes the check and adds the money to the account and notifies the player (in one embodiment, by e-mail). In one embodiment, account holders can close their account at any time. Any money remaining in such closed accounts is sent to the account holder by check. In an alternative embodiment, money is sent to the account holder by techniques for electronic funds transfer that are well known in the art.

Figure 2:
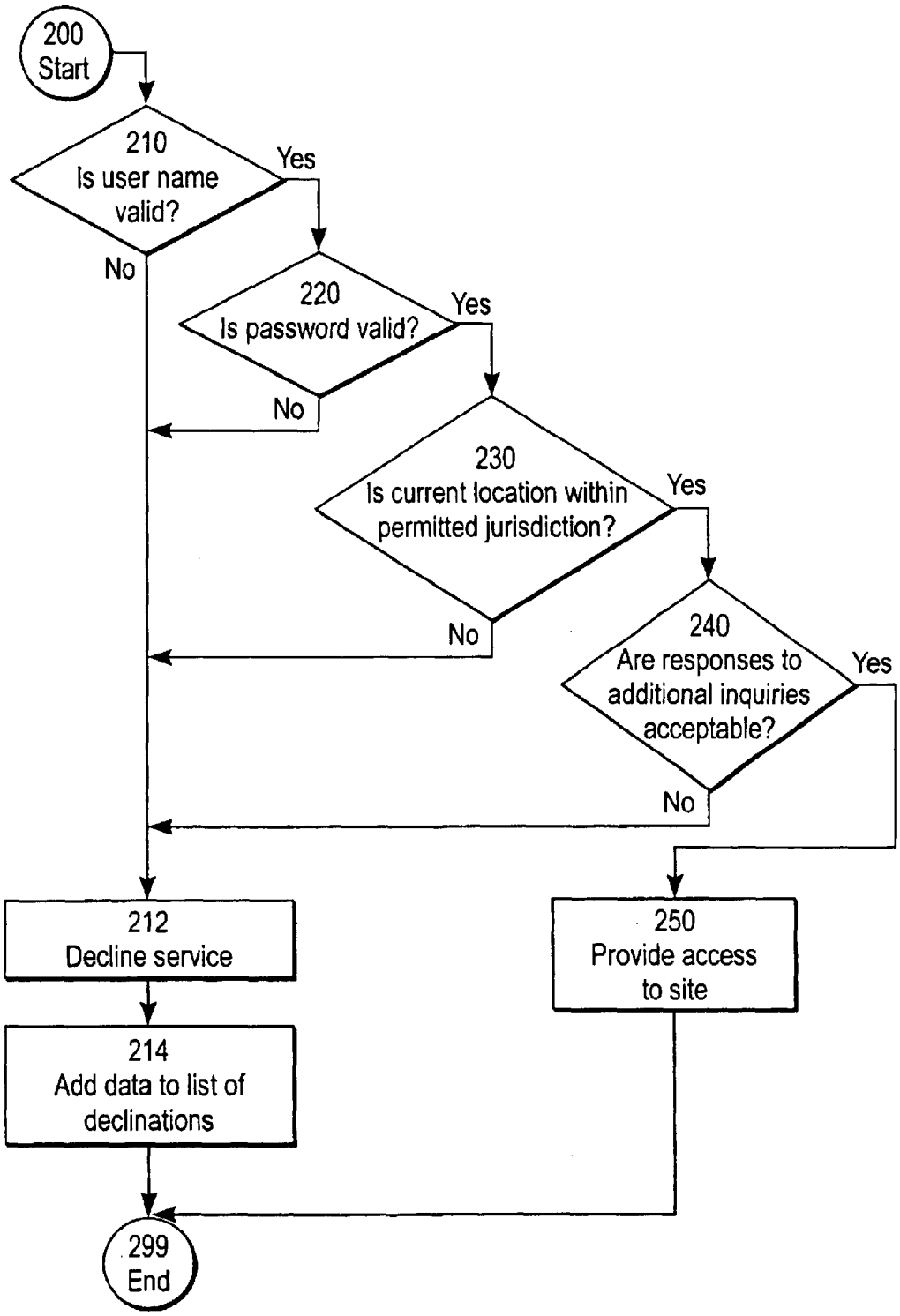
FIG. 2 is a flowchart of one embodiment of a process by which a player logs on to his account.

FIG. 2 is a flow diagram of one embodiment of a process for logging in a player and enabling the player's participation in a skill game. The process is performed by an operator using processing logic that may comprise hardware, software or a combination of both.

Referring to FIG. 2, the process beings by the operator receiving a user name (processing block 210) and password (processing block 220) provided by a potential player. If a correct user name is not provided, the operator declines access to the site (processing block 212). Also, if a correct password for the proffered user name is not provided, the operator of the site declines access (processing block 212). Processing logic records information about the failed entry on a list of declinations (processing block 214).

In one embodiment, the process by which a player logs on to an account additionally includes processing logic of the operator determining whether the latitude and longitude of the machine or internet service provider that originated the current communication with the operator of the skill game is within a permitted jurisdiction (processing block 230). If the current communication did not originate within a permitted jurisdiction, the operator of the site declines access (processing block 212).

The process by which a player logs on to an account may additionally include, in one embodiment, processing logic providing additional inquiries to the potential player by use of screens that appear on the player's display. In one embodiment, the additional inquiries include asking the potential player to assert (e.g., by clicking on a YES or NO button) that he is indeed the person who owns the account (processing block 240). If the answer is negative, the operator of the site declines access (processing block 212). Also, in one embodiment, the additional inquiries include asking the potential player to assert (e.g., by clicking on a YES or NO button) that he is of legal age (e.g., over the age of 18)(processing block 240). If the answer is negative, the operator of the site declines access (processing block 212). Finally, in one embodiment, the additional inquiries include asking the potential player to assert (e.g., by clicking on a YES or NO button) that player's current physical location is in a jurisdiction in which participation in the skill game is legal (processing block 240). In one embodiment, this additional inquiry is based on whether the player is using the same telephone number that was used in originally opening his account. If the answer is negative, the operator of the site declines access (processing block 212).

If the answers to these inquiries are all satisfactory, processing logic of the operator logs the player into his account and provides access to the site (processing logic 250).

In one embodiment, whenever any player logs on to the site, the time, the player's account number, user name, and IP address associated with the current communication is entered into a log for administrative purposes.

After successfully logging on to his account, the player may browse the site. In one embodiment, a variety of different skill games are available to the player at the site. The characteristics of each skill game that is offered is presented to the player. Such characteristics may include the name of the game, the subject matter of the game, the method of playing the game, the price for playing the game, the criteria for winning the game, and the prizes available for winning. In one embodiment, these characteristics include the number of previous players of the game and the numbers of prizes won by previous players. In one embodiment, a practice or sample instance of each game is provided to illustrate the play of the game to the player.

At some point, the player may choose to participate in a particular skill game available at the site. The player's account is then debited by the consideration (e.g., $1) for participating in such skill (assuming that the required amount is presently in the account). Each transaction is entered into a log (used for accounting and administrative purposes) indicating the player's account number, user name, time of transaction, an amount of the transaction. The player then plays the skill game.

FIG. 3 shows a skill game that uses several different queries based on knowledge about the presidents of the United States. In one embodiment, the queries are presented in the form of hints (e.g., in the style commonly used in crossword puzzles). For example, the queries in FIG. 3 are presented in the form of hints 310, the first of which is the hint "President who served non-consecutive terms." Similarly, queries shown in FIGS. 4, 6, 10, and 13 are also presented in the form of hints. In an alternative embodiment, queries are presented in the form of direct questions. For example, queries in FIG. 5 are presented in the form of direct questions 510, of which the first is the direct question "In what decade was the first woman elected to the U.S. Senate?"

In one embodiment, all the responses in the skill game belong to a category having a known and relatively small number of elements. For example, all the responses to the particular skill game in FIG. 3 are the names of the 41 presidents (indicated by 320 in FIG. 3). Other such games involve, for example, the names of the 50 states of the United States, the names of the 12 months of the year (as illustrated in FIG. 4), the 31 days of the month, the 10 decades of the Twentieth Century (as illustrated in FIG. 5) or other specified groups of ranges of years, and the seven days of the week (FIG. 10). Similar games can be constructed from other categories having a known and relatively small number of elements (e.g., provinces of Canada, kings and queens of England, states of Australia).

In the embodiments shown in FIGS. 3, 4, 5, 10 and 13, the method by which a player indicates his responses to the queries is to check off the name of a particular president (e.g., by clicking on an internet screen using a mouse). For example, the player would check off six responses from among the 41 possible responses in the area labeled 320 of FIG. 3.

Figure 15:
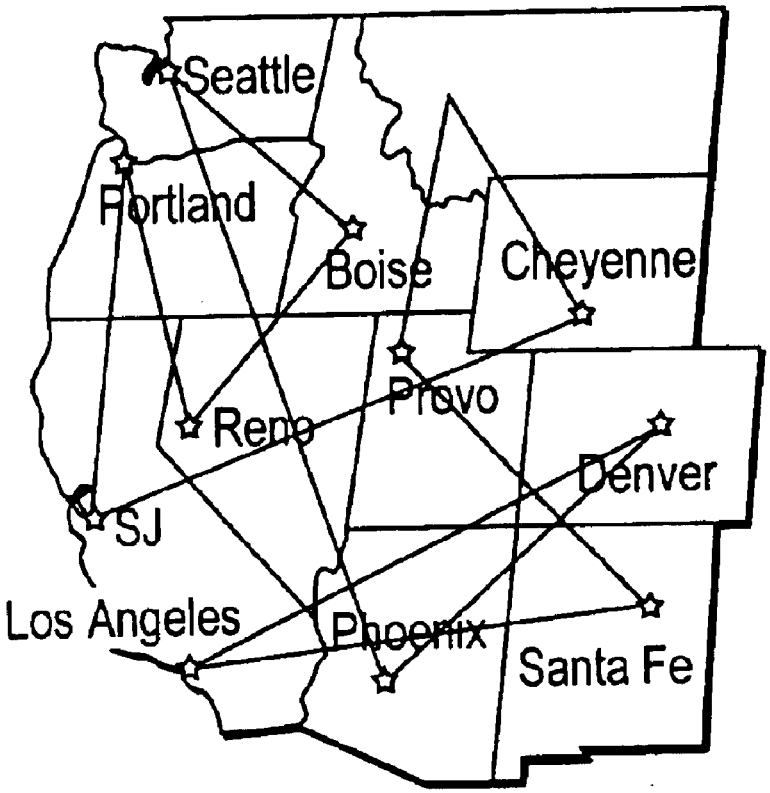
FIG. 15 shows a non-optimal itinerary connecting the 12 cities of FIG. 14.
Figure 18:
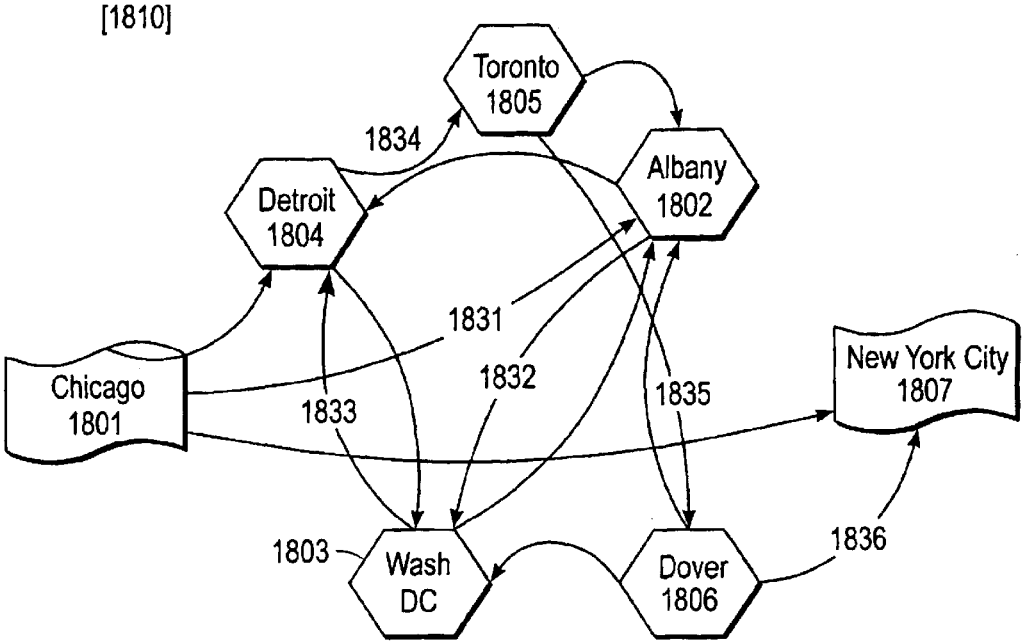
FIG. 18 illustrates a portion of the information on the screen for playing one embodiment of a game involving creating a Hamiltonian path between points.
Figure 19:
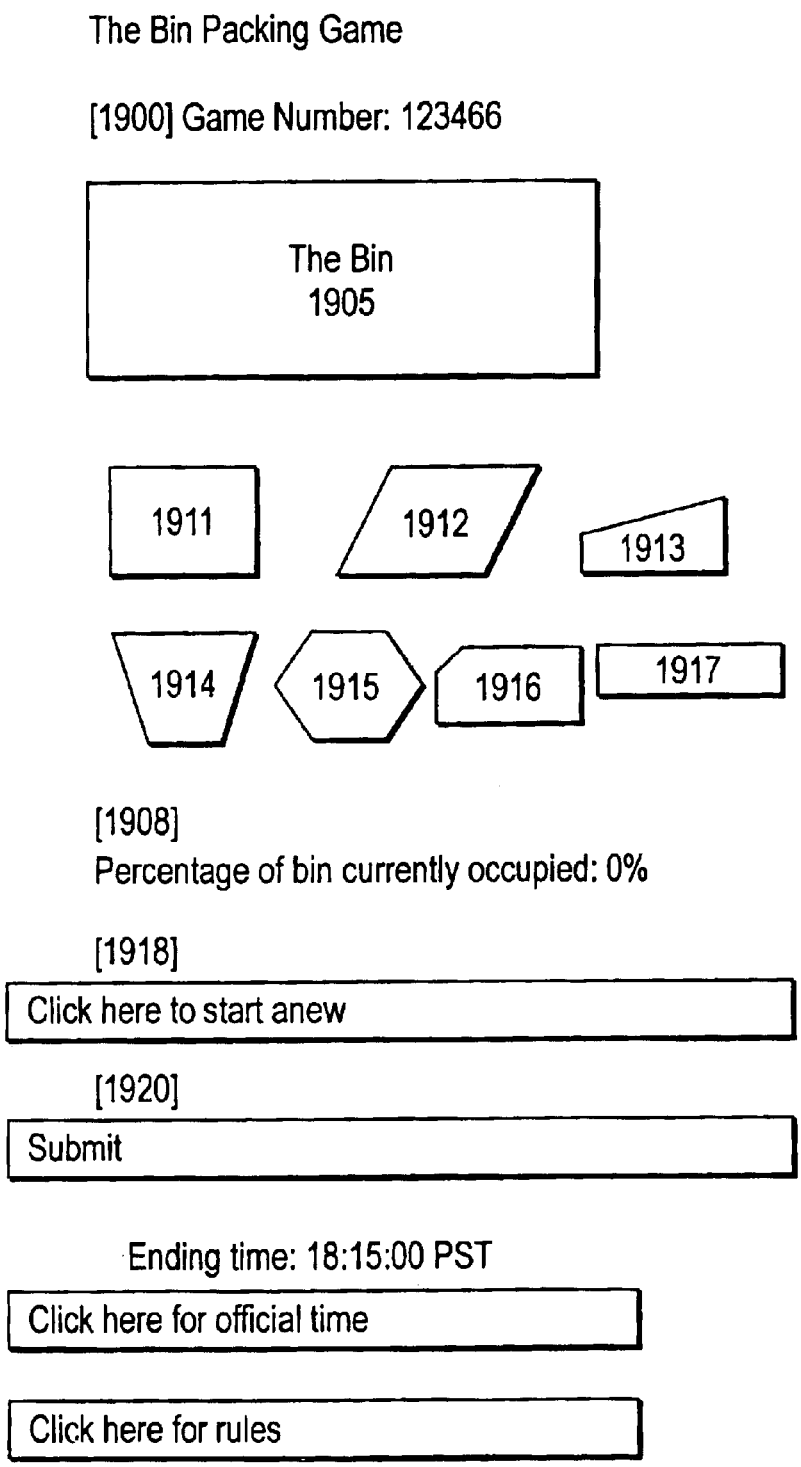
FIG. 19 illustrates a portion of the information on the screen for playing a bin packing game.
Figure 22:
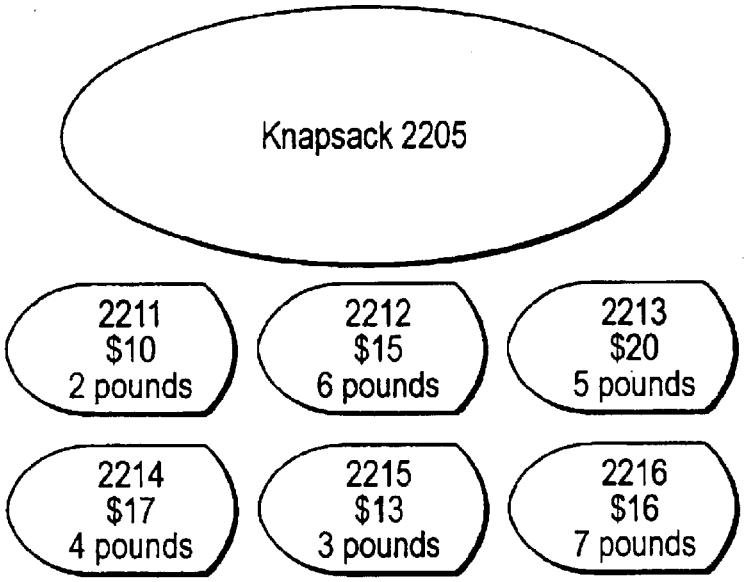
FIG. 22 shows the part of the information on the screen for playing a knapsack game.

There are numerous alternative mechanisms by which a player may indicate his responses to the above-mentioned skill games (FIGS. 3, 4, 5, 10 and 13) and other skill games described subsequently herein. For example, in an alternative embodiment, the player may indicate his responses to the skill games of FIGS. 3, 4, 5, 10 and 13 by typing the response (in the manner illustrated by FIGS. 6, 8, and 9). In another embodiment, the player may click on a special icon, drag the icon, and then drop the icon onto the names of each of the six presidents constituting his response (for the game illustrated by FIG. 3). In yet another embodiment, the player may click on the name of a president constituting his response, drag the name, and drop the name into a special area (perhaps a ballot box or other icon appropriate to the subject matter of the game). In yet another embodiment, the player may speak the word corresponding to his response. Existing speech recognition technology is capable of recognizing single spoken single words from a preidentified small repertoire of possible words. This approach is especially appropriate for the skill games illustrated by FIGS. 3, 4, 5, 10, 13, 15, 18, 19, and 22 where there is a small repertoire of possible responses. Existing speech recognition technology is currently especially efficient and robust at recognizing spoken numbers. Thus, depending on the nature of the words in the repertoire of possible responses for a particular skill game, it may be advantageous to assign a number to each of the possible answers (e.g., 1 for George Washington, 2 for John Adams, and so forth for the 39 other presidents). The player's response would then be a number and existing speech recognition technology can then be efficiently used to recognize the player's response. Similarly, existing speech recognition technology may be used for skill games in which the player's response consists of an unordered list of objects (each of which may be represented by numbers) as illustrated in FIGS. 19 and 22 and for skill games in which the player's response consists of an ordered set of city names (each of which may be represented by numbers) as illustrated in FIGS. 15 and 18.

In one embodiment, such as the skill game illustrated in FIG. 3, no element (e.g., president) in the list is the correct answer to more than one query. In this embodiment, only one list of the possible responses is provided and the player marks off the names of the six elements that he thinks are the correct responses to the six queries. An attractive screen appropriate to the subject matter of the skill game (e.g., presidents, geography, history) is provided to the player on which he can check off his choices based on his knowledge in the subject matter of the skill game.

In an alternative embodiment, an element in the list may be the correct answer to more than one query. In that event, one list of the possible responses is provided for each separate query and the player marks off the element that he thinks is the correct answers to each particular query. FIG. 4 shows the part of the information on the screen for playing a game in which the correct response to each of the three queries is a month of the year and in which the same month may be the correct answer to more than one of the three queries. The queries (in the form of hints) are at the point labeled 410 in FIG. 4. The player can check off one response from among the 12 possible responses in each of the three columns in the area labeled 420 of FIG. 4. In an alternate embodiment, the 12 signs of the zodiac may be used in place of the names of the 12 months.

In yet another alternative embodiment, FIG. 5 shows the part of the information on the screen for playing a game in which the correct response to each of two queries is a decade of Twentieth Century and in which in which the correct response to each query is a different decade.

If any response may be the correct response to any of the queries (as is the case in FIG. 4), then there are $N^Q$ possible ways of responding in the skill game if there are N possible responses to a query and there are Q queries. In the example of FIG. 4 involving 12 elements and three queries, there are 1,728 possible ways of making three responses. If there is exactly one correct answer for each of the three queries, one of these 1,728 ways of making three responses would be the correct answer for all three queries.

In contrast, when a response is the correct response to no more than one query (as is the case in FIG. 3 and FIG. 5), then there are $N!/[Q!(N-Q)!]$ possible ways of responding if there are N possible responses to a query and there are Q queries. (The exclamation point represents the factorial function, where N! is the product of the integers between 1 and N). In the example of FIG. 5 involving 10 elements and two queries, there are 45 possible ways of responding when a response is the correct response to no more than one query. In the example of FIG. 3 involving 41 elements and six queries, there are 4,496,388 possible ways of responding when a response is the correct response to no more than one query.

In one embodiment, the responses in the skill game belong to a large identified category; however, only a small subset of that category (including all the correct answers) is presented to the player as possible responses for that game. For example, all the responses may be first names of persons; however, only a limited number of first names may be presented to the player. In one embodiment, the identified categories may be historical figures or entertainment personalities. FIG. 13 shows the part of the information on the screen 1300 for playing a game in which the correct response to each query is the first name of a person and in which the correct response to each query is a one of 12 first names 1320 provided to the player. Two queries in the form of hints 1310. When the player completes his proposed solution, he clicks on the button entitled "Click here to submit your answers".

In one embodiment, the player is given only a limited total amount of time to play a game. In such an embodiment, the skill game ends after a specified amount of time (as shown at the point labeled 330 in FIG. 3 and at similar points in other figures). The player may obtain the official time at the site of the operator by clicking on a button or icon (as shown at the point labeled 350 in FIG. 3 and at similar points in other figures).

In one embodiment, the game is delivered to all the players at the same time (or approximately the same time). In this embodiment, after a player requests to participate in a game, his participation does not begin until the simultaneous beginning of the game for all players of that particular game. In another embodiment, after a player requests to participate in a game, his participation begins immediately.

In one embodiment, the same game may be presented to different players at different times.

When the player has finished his play of the game (e.g., responded to all the queries in the case of a query game), the player submits his responses to the operator of the skill game by clicking a button or icon (as shown at the point labeled 330 in FIG. 3 and at similar points in other figures) that transmits his response to the operator. In one embodiment, the player receives an acknowledgment for each submission.

For each skill game, the rules that govern that game are presented on a special screen that is accessible by clicking on a button or icon (as shown at the point labeled 360 in FIG. 3 and at similar points in other figures). These rules contain the authority for the correct answer (e.g., a particular dictionary or geographic atlas).

In one embodiment, each skill game that is offered bears a unique perpetual number for purposes of accounting and administration. For example, the game shown in FIG. 3 is numbered 123456 (as shown at the point labeled 300 in FIG. 3 and at similar points in other figures).

The determination of whether the player receives a prize is based on skill. The award criteria for each skill game is stated to the player as part of the description of the game that is available prior to the commencement of play of that game. In one embodiment, the award criteria involve correctly answering all the queries. In an alternative embodiment, the award criteria involve correctly answering more queries than other players participating in that particular skill game.

In another alternative, the award criteria involves awarding one prize for correctly answering a certain number (perhaps all) the queries and a different (typically lesser) prize for correctly answering a smaller specified number of the queries. One prize may entitle a player to make a play of another skill game offered by the operator of the site.

In yet another embodiment, the award criteria additionally favors the speed of the player is submitting answers to the queries, thereby combining both knowledge skill and speed skill. Thus, for example, if more than two players correctly answer all the queries, the player who first submits correct responses to all the queries would be preferred over a slower player who also submits correct responses to all the queries. Other examples of award criteria are presented below in connection with other types of games described below.

Each player of a particular game is informed of the outcome of the game. In one embodiment, the player is informed of the outcome of the game within moments of the time when he submits his response. This approach is especially suitable if all players are playing the game with the same starting and ending times. In an alternative embodiment, the player is informed of the outcome by e-mail. This approach is especially suitable if multiple players are playing the same game with staggered starting and ending times.

In another embodiment, if no player satisfies the award criteria of a particular skill game, the prize available in that game (or a designated part thereof) is added to the prize that would ordinarily be offered in a subsequently offered skill game.

When a player wins a prize in a skill game, the amount of the prize is added to his account. The player may use the money in his account to play additional game(s). In addition, a player who has won a prize may, at any time, request that the operator of the site send a check to the physical address that he has provided for the amount of the prize or for any or all of the money currently in his account. When a check is sent to a player, the amount of the check is debited from the player's account. In an alternative embodiment, money may be sent to the account holder by techniques for electronic funds transfer that are known in the art. In another embodiment, money may be transferred to the account holder by a direct credit to his credit card account. In this embodiment, the operator of the skill game may compensate the manager of the credit card account for the amount of the transfer (plus the fee charged for the transfer by the manager of the credit card account).

In another embodiment, the possible responses to the queries belong to an identified category consisting of a very large number of possibilities. Examples are skill games where the possible responses are the names of geographic places, historical events, dates, biographic figures, entertainment personalities and their works, words, or numbers. In this embodiment, no list of possible responses is presented to the player. The player indicates his responses to a query by typing in his response onto a space provided on his screen. In one embodiment, the number of letters in the correct response is indicated to the player by providing a particular number of blank spaces in which to insert a letter (such as, for example, illustrated in FIG. 8 where all responses are five letter words and as also illustrated by the crossword-style form of FIG. 6 that indicates the number of letters in each response). In an alternative embodiment, the number of letters in the correct response is open-ended and the number of letters is not indicated to the player (such as, for example, illustrated by FIG. 9).

Figure 7:
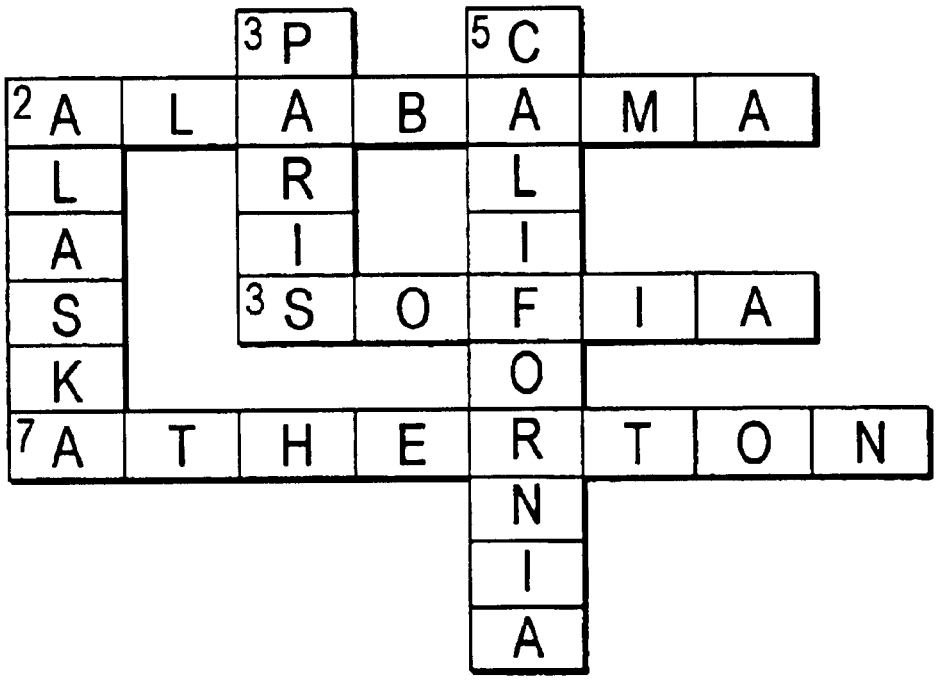
FIG. 7 shows the correct responses to the crossword game of geography of FIG. 6.

In yet another embodiment, the player is provided with a visual presentation in at least two dimensions of possible responses in the familiar style of a crossword puzzle. FIG. 6 shows part of the information on the screen for playing a crossword game in which all the correct responses belong to the category of geographical places. FIG. 7 shows the correct responses belong to the crossword game of geography of FIG. 6. The visual presentation 620 indicates the number of letters of the alphabet in each correct response. As in crossword puzzles, words are laid out in the horizontal or "across" direction, such as the seven-letter word beginning at the point labeled 2 and words are additionally laid out in the vertical or "down" direction, such as the five-letter word beginning at the point labeled 3. As in crossword puzzles, there are numerous instances where a letter in the correct response to one of the queries (e.g., a word laid out in the vertical or "down" direction) intersects with a letter in the correct response of another of queries (e.g., a word laid out in the horizontal or "across" direction). Such an intersection is illustrated by point 630 in FIG. 6. Point 630 is the second letter of the five-letter vertical word beginning at the point labeled 3 and is the third letter of the seven-letter horizontal word beginning at the point labeled 2. In an alternative embodiment, one or more correct letters may be provided as clues to the player. In one embodiment, all the correct entries in the crossword belong to a particular category, such as the names of geographic places, historical events, biographic figures, or entertainment personalities and their works.

In yet another embodiment, the crossword may be presented in three dimensions. Techniques for displaying objects in three dimensions are well-known in the art.

In yet another embodiment (e.g., FIG. 8, FIG. 9, etc.), the player is provided with a single starting word, single starting number, multiple starting words, or multiple starting numbers. For example, there is a single starting word, STEAK, at the point labeled 810 in FIG. 8 and there is a single starting word, ARITHMETIC, labeled 910 in FIG. 9. In this letter reallocation game, each response is a word composed of letters of the starting word(s). This skill game may be played in various ways. For example, in one embodiment, each letter of the starting word may used once and only once in creating each response (so that the responses are words of the same length as the starting word). FIG. 8 shows the part of the information on the screen for playing a game in which a single five-letter starting word (STEAK at the point 810) is provided, each response is a word composed of letters of that word, and each letter of the starting word is used once and only once in creating each response. Thus, correct responses in the game with a five-letter starting word of STEAK include (but are not limited to) words such as STAKE, SKATE, and TAKES. As shown in FIG. 8, all responses contain five letters. The player can type in the letters of responses such as STAKE, SKATE, and TAKES in the area labeled 820 in FIG. 8 in which each line accommodates exactly five letters.

In another embodiment, each response is a word composed of letters of that word, but each letter of the starting word may be used zero, one, or more times in creating a response and it is not necessary to use all the letters. FIG. 9 shows the part of the information on the screen for playing a game in which a single starting word is provided, each response is a word composed of letters of that word, and each letter of the starting word may be used zero, one, or more times in creating a response. Thus, correct responses in this skill game with a starting word of ARITHMETIC include (but are not limited to) words such as METRIC, HARE, THE, and TART. Note that the word TART is a correct response to this version of this game. However, in an alternate embodiment, a letter of the starting word may only be used as many times in the response as it appears in the starting word. In that version of the game, the word TART would not be a correct response. The player can type in the letters of a response, such as METRIC, on the first line of the area labeled 920 in FIG. 9.

Skill determines whether a particular players wins a prize in any of the games represented by FIGS. 3, 4, 5, 6, 7, 8, 9, 10, 13, 14, 16, 18, 19, and 22 (and the variations of them mentioned herein).

In an alternative embodiment, a game may include a chance component in addition to the skill component. The jurisdictions in which such a game is legal would, in general, be fewer than for a game of pure skill. The legality of such a game would depend on the application of the legal criteria of the jurisdiction involved to the details of the design of the game involved.

In games of chance, it is often possible to compute the probability of winning the game using mathematical principles. For example, in the three-digit "daily numbers" game (which is offered by many state-operated lotteries in the United States), the player enters a daily lottery game by choosing a three-digit number. At the specified time in the evening, a random drawing is conducted in order to select the day's winning three-digit number. The selection of the three numbers may be done using three wheels, each of which is divided into 10 parts. The three wheels are each spun (typically as part of a one-minute television show). The place where the first wheel stops determines the first digit of the day's winning number. The places where the second and third wheels stop determine the second and third digits, respectively, of the day's winning number. In this game of chance, a player's probability of winning are 1 in 1,000. This probability is computed from the fact that there are 1,000 possible combinations of three digits and each is equally likely to be drawn in the drawing.

In contrast, the probability of winning a skill game cannot be computed in advance in a similar way. The probability that a particular player will win depends on the player's individual skill (e.g., knowledge) of the subject matter of the particular skill game involved. Moreover, the number of winners of a skill game depends on the skill of the various individual players of the group. Thus, the operator of a particular skill game generally assumes a certain amount of risk based on the accuracy of estimates of the of the number of winners in the anticipated group of players.

A potential player of the above-described skill games may advantageously communicate with the operator of the skill game by use of network communications, such as the internet. The originator of communication on the internet is typically either a computer that is directly connected to the internet (as is the case with many business, industrial, educational, and governmental users and some individual residential users) or a computer that makes a connection indirectly by a connection over local telephone service to an internet service provider (ISP) who is, in turn, directly connected to the internet. Individual residences and business are also sometimes connected to the internet by the use of a cable and other mechanisms. When a web site is visited on the internet, the IP address of the server or internet service provider originating the connection is generally known to the internet site.

When a potential player asserts a physical address as part of the process of opening a new account (FIG. 1) or attempts to log on to an account (FIG. 2), this assertion by the potential player can be compared to the known geographic location (latitude and longitude) of the computer that is directly connected to the internet or the computer that is indirectly connected to the internet by a connection over local telephone service to an internet service provider (ISP). Participation can be disallowed if the assertion does not match known information about the geographic location of the IP address from which the potential player is communicating with the operator of the skill game.

In one embodiment, the operator of the skill game also operates (or arranges for the operation of) servers on the internet or internet service providers whose incoming telephone lines are equipped with techniques for caller identification of telephone calls. The well-known techniques of caller identification permit the determination of the telephone number that called the server or internet service provider. The telephone number is indicative of the geographic area from which the telephone call originated.

The Neo Trace software (Version 2.12a dated Feb. 1, 2000) provides one way to identify communication paths over the internet. For purposes of illustration, potential player is assumed in Los Altos, Calif. and the operator of the skill game is assumed to be in San Diego, Calif. Network communication over the internet typically occurs in a sequence of hops starting from a server or an internet service provider at the origin of the communication, traveling between various intermediate network service providers, and eventually reaching the internet service provider or server at the destination.

Figure 11:
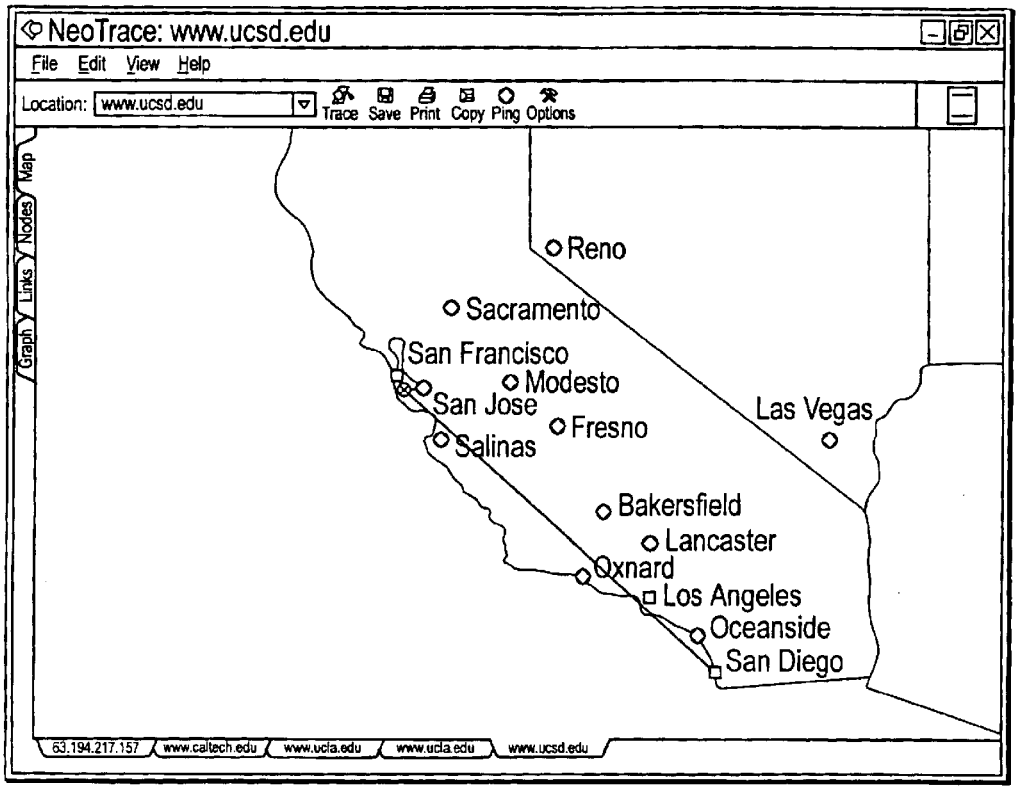
FIG. 11 illustrates an illustrative communication path originating at a computer that is located in Los Altos Hills, Calif. and terminating at a computer in San Diego, Calif.

FIG. 11 shows an illustrative communication path originating at a computer name "huxley" (whose IP address on the internet is 172.16.0.3) that is located in at 37.385 North latitude and 122.113 West longitude in Los Altos Hills, Calif. and terminating at www.ucsd.edu at the University of California in San Diego (IP address 132.239.50.184 at infopath.ucsd.edu) located at 32.708 North latitude,117.142 West longitude.

Figure 12:
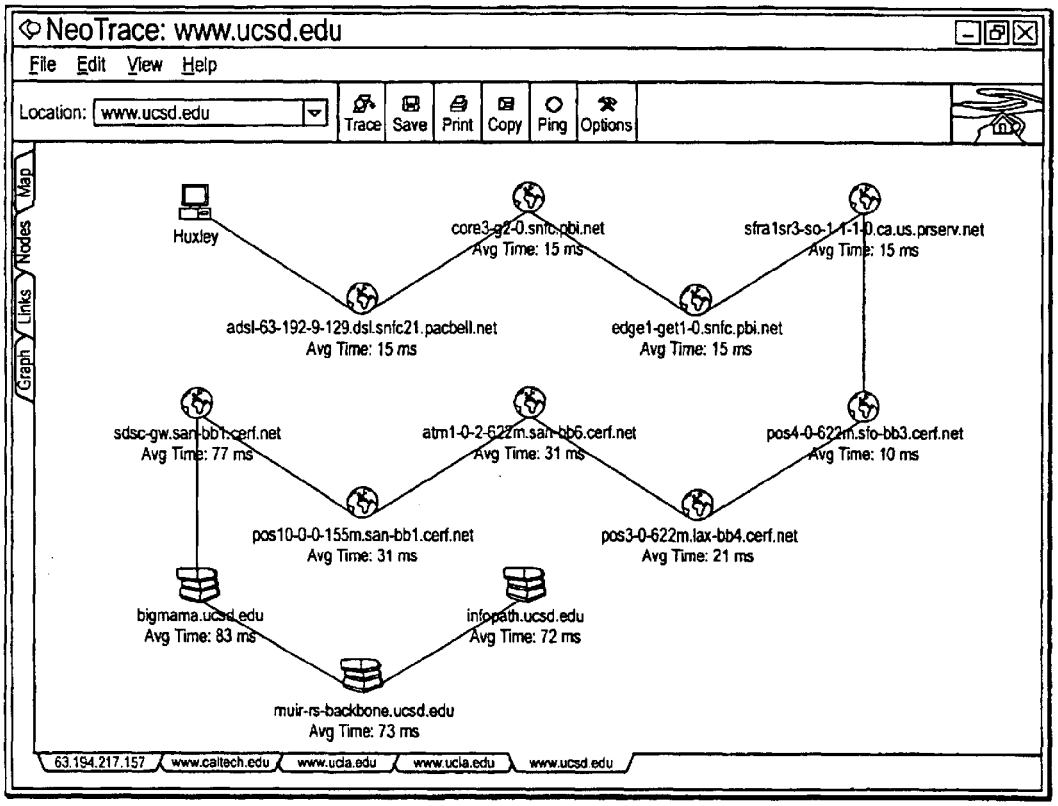
FIG. 12 shows the 13 hops in the illustrative communication path shown in FIG. 11.

Table 1 and FIG. 12 show the 13 hops in the illustrative communication path shown in FIG. 11. As is shown in both Table 1 and FIG. 12, the illustrative communication shown in FIG. 11 first travels north from Los Altos Hills to San Francisco to Pacific Bell Internet Services (whose IP address is 63.192.9.129 at adsl63-192-9-129.dsl.snfc21.pacbell.net and further identified as "PACBELL2-DOM") and proceeds south over the remaining hops of the communication path until it reaches its destination in San Diego.

TABLE 1

Illustrative internet communication path

| Hop | Machine | IP address |
|---|---|---|
| 1 | huxley | 172.16.0.3 |
| 2 | adsl-63-192-9-129.dsl.snfc21.pacbell.net | 63.192.9.129 |
| 3 | core3-g2-0.snfc21.pbi.net | 206.171.134.130 |
| 4 | edge1-ge1-0.snfc21.pbi.net | 209.232.130.20 |
| 5 | sfra1sr3-so-1-1-1-.ca.us.prserv.net | 165.87.161.74 |
| 6 | pos4-0-622m.sfo-bb3.cerf.net | 134.24.32.189 |
| 7 | pos3-0-622m.lax-bb4.cerf.net | 134.24.29.234 |
| 8 | atm1-0-2-622m.san-bb6.cerf.net | 134.24.32.61 |
| 9 | pos10-0-0-155m.san-bb1.cerf.net | 134.24.29.129 |
| 10 | sdsc-gw.san-bb1.cerf.net | 134.24.12.2 |
| 11 | bigmama.ucsd.edu | 192.12.207.5 |
| 12 | muir-rs-backbone.ucsd.edu | 132.239.254.11 |
| 13 | infopath.ucsd.edu | 132.239.50.184 |

In one embodiment, the latitude and longitude of the machines of the intermediate hops in the communication path may be considered in determining eligibility to participate in a skill game.

In another embodiment, the web site (residing on a machine or at an internet service provider) that hosts the skill game is connected to the main site of the operator of the skill game by a communication path, each part of which is known to lie within the jurisdiction in which skill games of the type being offered are legal.

There are numerous other skill games other than those based on providing responses to queries.

Figure 14:
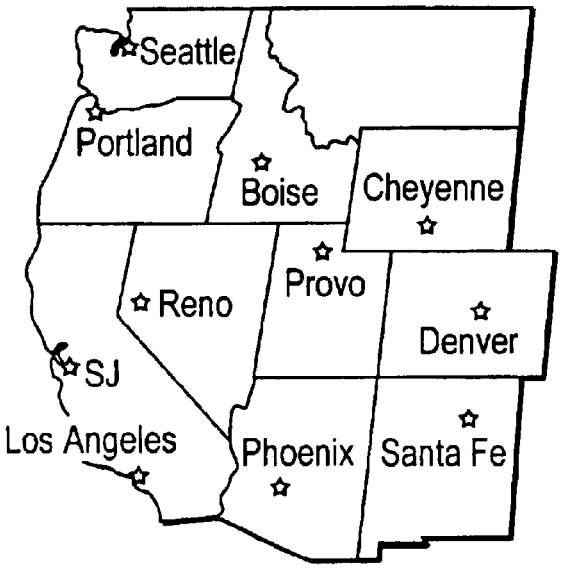
FIG. 14 illustrates a portion of the information on the screen for playing one embodiment of a game involving creating a path of minimal total length connecting 12 cities.

The well-known mathematical traveling salesman problem can be used as the basis for a skill game. This game involves a map with a certain number of geographical locations. The geographical locations may be cities, tourist attractions, mountain peaks, intersections of streets in a city, or any other geographic feature. FIG. 14 shows the part of the information on the screen 1400 for playing one embodiment of a skill game with a map in which the geographic locations consist of 12 cities (Los Angeles, San Jose, Reno, Portland, Seattle, Boise, Helena, Cheyenne, Provo, Denver, Santa Fe, and Phoenix).

The goal of the skill game in FIG. 14 is to create a minimal-length itinerary (tour) that visits each geographical location once and only once (and returns to the starting location). For example, the player may start at any geographical location (say, Los Angeles). The player then chooses the second geographical location of the itinerary. This process continues until the player has chosen each of the geographical locations exactly one time each.

In one embodiment, the player provides his input by clicking on the first geographical location, then clicking on the second geographical location, and so forth, until the player has clicked on all geographical locations. In one embodiment of the traveling salesman game, as the player chooses each new geographical location (city), a line is automatically drawn, using processing logic, between the new city and the previous city as an aid to the player in visualizing the itinerary that he is creating. In one embodiment, the total mileage of the player's existing partial itinerary is computed, using processing logic, and displayed to the player as an additional aid in playing the game. If a player clicks on a city that is already included in his partial itinerary, the player is informed that that choice is not allowed (by a visual or auditory signal, or both). When the player completes his proposed solution, he clicks on button 1420 in FIG. 14 entitled "Click here to submit your answer".

In one embodiment, a button 1415 in FIG. 14 is provided to enable the player to delete the previous segment of a tentative itinerary. This button may be repeatedly applied to delete additional previous segments of the tentative itinerary. In one embodiment, button 1418 in FIG. 14 is provided to enable the player to delete his entire tentative itinerary and start over.

In another embodiment, the player enters a number next to the name of each geographical location to indicate the order of visiting the geographical locations. In the case of the map of FIG. 14, the player would enter a number between 1 and 12 next to each city's name, with each number being used exactly one time.

Suppose the player chooses Los Angeles as his starting city, the player's chosen second city is Denver, and the player's chosen third city is Phoenix. FIG. 15 shows a 12-city itinerary of which Los Angeles, Denver, and Phoenix are visited first. The itinerary shown in FIG. 15 is a very poor itinerary. For example, it clearly would have been better to have traveled from Los Angeles to Phoenix to Denver rather than from Los Angeles to Denver to Phoenix. FIG. 15 contains several other non-optimal sub-tours. By employing one's own skill and judgment, one can quickly develop an itinerary that is superior to that of FIG. 15. An individual expending even more effort can develop an even better itinerary. The determination of the very best itinerary is not obvious. In general, the discovery of the optimal itinerary for the traveling salesman problem entails considerable skill.

In a traveling salesman problem involving even a modest number of cities, the number of distinct itineraries is larger than that which can be evaluated mechanically on a computer in any reasonable amount of time (e.g., in relation to the limited amount of time that the player is given to play the skill game). Specifically, the number of different permutations of N cities is N! (i.e., N factorial). Since the starting city and the order of traversal do not matter, the number of distinct itineraries is the number of different permutations divided by both N and 2, namely $(N-1)!/2$. As an example, for only 15 cities there are about 654 billion distinct itineraries.

In one embodiment, it is possible to click on each geographical location and bring up a small informational window indicating the distance (mileage) from each geographic location to each of the other geographical locations. In another embodiment, this distance information is provided in the familiar format of a two-dimensional mileage table, where each entry in the table is the distance between two geographic locations. In another embodiment, only the visual image of the map and geographical locations are provided.

The award criterion for this traveling salesman game may be attainment of an itinerary that is known to be optimal, attainment of at least a previously calculated near-optimal itinerary, or attainment of an itinerary that is better than that submitted by any other player.

In one alternative (applicable to this game and other skill games described below), the award criteria involves awarding one prize for correctly achieving a specified level of performance and at least one different (typically lesser) prize for achieving a specified lesser level of performance. In yet another embodiment, the award criteria additionally favors the speed of the player is submitting his response to the challenge presented by the game, thereby combining two kinds of skill. Thus, for example, if more than two players achieve the same specified level of performance, the player who first submits his response would be preferred over a slower player who also achieves the same level of performance. In another embodiment, one prize entitles the player to make a play of another skill game offered by the operator of the site.

In one embodiment (as shown by, for example, FIG. 14 and FIG. 15), the distance between the geographic locations is measured as the crow flies (that is, by Euclidean distance), as measured on either a flat surface or a spherical surface. However, in an alternative embodiment, the map includes routes (e.g., in the form of highways or streets) connecting the various geographic locations. In that embodiment, the itinerary must be along the routes shown and the distance is measured along the routes shown (as opposed to the distance as the crow flies). In one embodiment, the highways or streets are actual highways and streets of actual geographic areas.

Another example of a skill game is based on the well-known idea of a jigsaw puzzle. In such a game, there are a certain number of given pieces. The pieces are, in general, of different size and shape. If the given pieces are assembled correctly, they form a contiguous composition employing all of the pieces, such that the composition contains no gaps between any of the pieces.

Figure 16:
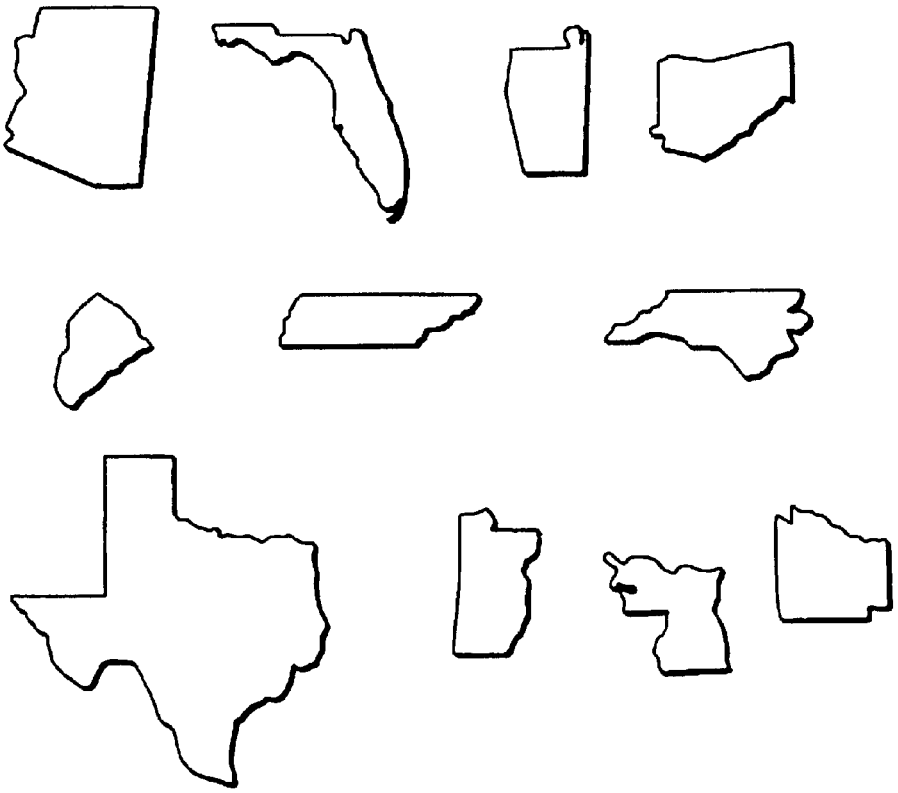
FIG. 16 illustrates a portion of the information on the screen for playing one embodiment of a jigsaw puzzle game.

FIG. 16 shows the part of the information on the display 1600 for playing one embodiment of a skill game based on a jigsaw puzzle with 11 pieces. In the game, the player is presented with the 11 disconnected pieces 1610.

Figure 17:
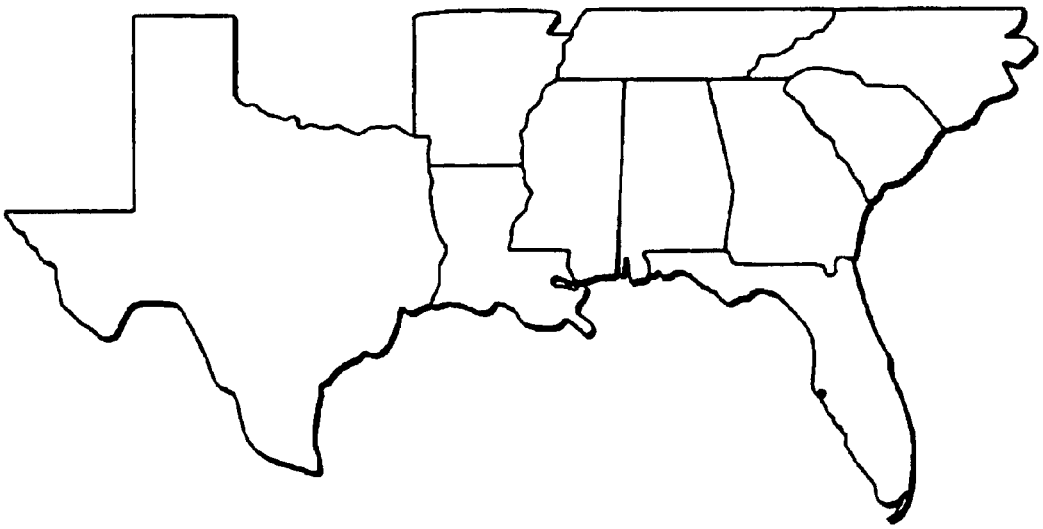
FIG. 17 shows a solution to the jigsaw puzzle game of FIG. 16.

FIG. 17 shows a solution to jigsaw puzzle game of FIG. 16, namely an arrangement in which the 11 southern states are contiguously arranged (with no gaps) so as to form a map. By comparing FIG. 16 with FIG. 17, the 11 pieces are not originally presented to the player in the orientation that they are needed in the correct final composition. Several of the states in FIG. 16 are rotated by various amounts (e.g., 90, 180, or 270 degrees) from their correct orientation. In one embodiment, pieces may be rotated by any angle. In one embodiment, the player provides his proposed solution by using a mouse pointer to move and rotate the given pieces. The player submits his entry by clicking on button 1620 in FIG. 16 entitled "Click here to submit your answer".

The award criterion for this jigsaw puzzle game may be attainment of a previously calculated perfect solution, attainment of a partial solution that employs a certain number of contiguous pieces, or attainment of a partial solution that employs more contiguous pieces than any entry submitted by any other player.

In one embodiment, at least some of the pieces may be originally presented to the player upside down. In this embodiment, the player is also capable of flipping the given pieces. All the boundaries of all the pieces may be straight lines. Also, in one embodiment, all of the pieces are of uniform coloration. In an alternative embodiment, the pieces bear a portion of an overall image. These portions of the overall image on the individual pieces serve as clues to the player in assembling the overall image. The overall image becomes apparent when all of the pieces are assembled into the correct final composition.

In the example of FIGS. 16 and 17, no outer boundary is indicated to the player. In one embodiment, the composition is constrained to a prespecified outer boundary and all the pieces fit inside this boundary.

In addition, the well-known mathematical problem of discovering Hamiltonian paths can be used as the basis for yet another skill game. This game involves a graph consisting of a certain number of points (nodes) and various directed (one-way) lines connecting various pairs of points. Given any two points, there may be no line connecting the two points; there may be a one-way line going from the first point to the second point; there may be a one-way line going from the second point to the first point; or there may be two lines (one in each direction) connecting the two points. There is a designated starting point and a designated ending point. In one embodiment, this problem can be presented in the form of a map in which cities correspond to the points (nodes of the graph) and in which lines (with an arrow at one end) correspond to directed (one-way) lines. In one embodiment, the directed lines may be visualized as available airline flights going from one particular city to another city. The goal of the skill game is to create an itinerary (tour) that starts at the designated starting city, ends at the designated ending city, and that visits each other city once and only once, with each segment of the itinerary being in a permissible direction.

FIG. 18 shows the part of the information on the screen 1800 for playing a skill game based on this Hamiltonian path problem involving seven cities. In the map 1810 depicting the game, the starting city is Chicago 1801 and the ending city is New York 1807. The intermediate cities are Albany 1802, Washington 1803, Detroit 1804, Toronto 1805, and Dover 1806. There is a Hamiltonian path from starting city Chicago 1801 to ending city New York 1807 consisting of the following six directed (one-way) segments: segment 1831 from Chicago to Albany, segment 1832 from Albany to Washington, segment 1833 from Washington to Detroit, segment 1834 from Detroit to Toronto, segment 1835 from Toronto to Dover, and segment 1836 from Dover to New York 1807.

In one embodiment, a player indicates his choices by clicking on a directed (one-way) line leaving the designated starting city, then clicking on a directed line leaving the second city, then continuing in the same manner until the itinerary reaches the designated ending city, with each city being visited once and only once.

In one embodiment of the Hamiltonian path game, as the player clicks on successive directed line segments, the player is visually presented, using processing logic, with a count of the number of lines that he has clicked so far. The count is at zero at the beginning of the game and reaches N−1 (where N is the number of cities) if and when a satisfactory complete Hamiltonian path is discovered. In one embodiment, certain lines are highlighted as a visual aid to the player. For example, if the player first clicked on the line connecting starting city Chicago 1801 (FIG. 18) with Detroit 1804, the two outgoing directed line segments from Detroit 1804, namely the directed line segment from Detroit 1804 to Washington 1803 and the directed line segment from Detroit 1804 to Toronto 1805 are highlighted. The player is thus presented with the two alternatives that he has for leaving Detroit 1804. In one embodiment, a player need not begin at the starting city, but may instead work backwards from the ending city or work forwards or backwards from any directed line segment on the map. In one embodiment, when the player starts by first clicking on a line going into the ending city, the incoming directed line segments to the other end of that line are highlighted (as opposed to highlighting the outgoing directed line segments, as was the case when the player starts by first clicking on a line coming out of the starting city). In one embodiment, when the player starts by first clicking on a line that is not connected to either the starting city or the ending city, the directed line segments going out from the end of that line and the directed line segments coming in to the beginning of that line are highlighted as a visual aid to the player. The player submits his entry by clicking on button 1820 in FIG. 18 entitled "Click here to submit your answer".

In one embodiment, button 1815 in FIG. 18 is provided to enable the player to delete the previous lines of a tentative itinerary. This button may be repeatedly applied to delete additional previous lines of the tentative itinerary. In one embodiment, button 1818 in FIG. 18 is provided to enable the player to delete his entire tentative itinerary and start over.

The award criterion for this Hamiltonian path game may be attainment of a previously calculated complete itinerary, attainment of a partial itinerary that visits a certain number of the cities, or attainment of an itinerary that visits more cities than any other player.

The discovery of a satisfactory itinerary is not obvious. Although a Hamiltonian path problem with seven cities (as shown in FIG. 18) may be relatively easy to solve, the problem becomes very difficult for larger numbers of objects. In general, the discovery of a satisfactory itinerary entails considerable skill. In a Hamiltonian path problem involving even a modest number of cities, the number of distinct itineraries is larger than that which can be evaluated mechanically on a computer in any reasonable amount of time (e.g., in relation to the limited amount of time that the player is given to play the skill game).

The Hamiltonian path problem differs from the previously described traveling salesman problem in that the player sequentially chooses directed lines in the Hamiltonian path problem, but sequentially chooses geographical locations (cities) in the traveling salesman problem. In addition, the Hamiltonian path problem differs from the previously described traveling salesman problem in that distances play no role in the Hamiltonian path problem.

Both the Hamiltonian path problem and the traveling salesman problem are examples of combinatorial optimization problems of the type that are considered, in general, to be difficult to solve (Garey and Johnson 1979).

The well-known bin packing problem can be used as the basis for yet another skill game. The bin packing problem involves a two-dimensional region (called the "bin") and a collection of two-dimensional objects. Each of the objects has a particular size and shape. The goal is to insert objects into the bin so as to maximize the percentage of the surface area of the bin that is occupied by the inserted objects. An object may be inserted at most one time into the bin; however, it is possible that the set of objects at the beginning of the game may include multiple copies of a particular object.

In one embodiment, some or all of the objects are rectangles. In alternative embodiments, the objects are polygonal shaped or irregularly shaped.

In one embodiment, the bin is a single rectangle. In alternative embodiments, the bin is polygonal shaped or irregularly shaped. In another embodiment, the bin consists of two or more distinct sub-regions (e.g., two rectangles).

The discovery of an optimal packing configuration is unobvious. The percentage of the surface area of the bin that can be occupied (even with an optimal packing configuration) is usually much smaller than a person would initially estimate. It is not necessarily true that the highest percentage is achieved by inserting the greatest number of objects.

FIG. 19 shows the part of the information on the display 1900 for playing a skill game based on the bin packing problem. In the particular instance of the bin packing problem shown, there are seven polygonal objects, including two rectangles (1911 and 1917) and five polygonal objects (1912, 1913, 1914, 1915, and 1916). The object of the game is to insert some or all of the seven objects into the bin 1905 so as to increase the percentage of the surface area of the bin 1905 that is occupied by the inserted objects.

The game starts with none of the objects inside the bin (as shown in FIG. 19). In one embodiment, a player selects an object (by clicking on it) and then drags it to the particular location in the bin where he desires to insert it. The player also the ability to rotate the object as he is moving and inserting it into the bin. If an object cannot be inserted in a particular place (e.g., because it does not fit, because it is not entirely inside the bin, or because it overlaps with an already inserted object), the player receives, by means of processing logic, an error indication (which can be visual, auditory, or both). After the player successfully inserts an object into the bin, the percentage of the surface area of the bin that is currently occupied by inserted objects is computed, by processing logic, and is visually shown to the player (at 1908 in FIG. 19). The player can select, rotate, and drag objects that are currently either outside the bin (i.e., in their original-starting location, as shown in FIG. 19) or that are already inside the bin. The player may remove an object from the bin in the process of trying to find the best solution. If the player removes an object from the bin, the percentage of the surface area of the bin that is then occupied by inserted objects is recomputed, by processing logic, and is visually shown to the player (at 1908 in FIG. 19). When the player completes his packing configuration, he clicks on button 1920 entitled "Submit" in FIG. 19.

In one embodiment, button 1918 in FIG. 19 is provided to conveniently enable the player to delete his entire current packing configuration and start anew.

The award criterion for this bin-packing game may be attainment of at least a previously calculated packing configuration that is known to be optimal, attainment of at least a previously calculated near-optimal packing configuration, or attainment of a packing configuration that is better than that submitted by any other player.

Although a bin packing problem with seven objects (as shown in FIG. 19) may be relatively easy to solve, the problem becomes very difficult for larger numbers of objects. In a bin packing problem involving even a modest number of objects, the number of distinct packing configurations is larger than that which can be evaluated mechanically on a computer in any reasonable amount of time (i.e., in relation to the limited amount of time that the player is given to play the skill game). The bin packing problem, like the Hamiltonian path problem and the traveling salesman problem, is an example of an vexatious combinatorial optimization problem (Garey and Johnson 1979).

The knapsack problem can also be used as the basis for yet another skill game. The knapsack problem involves a knapsack and a collection of objects (sometimes called "rocks"). Each of the objects has a particular weight and a particular value. For example, a piece of diamond may be light, but very valuable whereas a piece of granite may be heavy, but not very valuable. The goal is to insert objects into the knapsack so as to maximize the total value of all the objects in the knapsack, subject to the constraint that the total weight of the inserted objects does not exceed a certain preestablished maximum weight.

FIG. 22 shows the part of the information on the screen 2200 for playing a skill game based on the knapsack problem. In the particular instance of the knapsack problem shown, there are six given objects. The six objects are labeled 2211 through 2216 in FIG. 22. The object of the game is to insert some or all of the given objects into the knapsack 2205 so as to maximize the total value of the objects in the knapsack, provided that the total weight of the inserted objects does not exceed the preestablished maximum weight (maximum allowed weight indication 2206). For example, object 2211 weights 10 pounds and is worth $10 and the preestablished maximum weight 2206 for this instance of the knapsack game is 10 pounds.

The game starts with none of the six objects (2211 through 2216) inside the knapsack 2205. At the start of the game, the total weight of the objects currently in the knapsack is zero. Likewise, the total value of the objects currently in the knapsack is zero. In one embodiment, a player selects an object (by clicking on it) and then drags it into the knapsack. In contrast to the bin packing game, the size and shape of the objects are irrelevant to the play of this game. In contrast to the jigsaw game and the bin packing game, the exact placement in the knapsack and the exact relative location of the objects in the knapsack is not relevant to the play of this game. The relevant factors in the knapsack game are the weight and value of the objects that are inserted into the knapsack. If the attempted insertion of an object would cause the weight of the knapsack to exceed the preestablished maximum weight indication 2206, the player receives, by the use of processing logic, an error indication (which can be visual, auditory, or both). After the player successfully inserts an object into the knapsack 2205, the total weight of the objects currently in the knapsack is computed, by processing logic, and is visually shown to the player (total weight indication 2208 in FIG. 22). Also, the total value of the objects currently in the knapsack is computed, by processing logic, and is visually shown to the player (total value indication 2209 in FIG. 22). The player may remove any object from the knapsack in an attempt to find the best solution (by clicking on it and dragging it out of the knapsack, in one embodiment). When the player removes an object from the knapsack, the total weight and the total value of the objects currently in the knapsack is recomputed, by processing logic, and is visually shown to the player (using indications 2208 and 2209). A particular object may be inserted at most one time into the knapsack; however, it is possible that the set of objects at the beginning of the game may include duplicates of a particular object. When the player completes his entry, he clicks on "submit" button 2220.

In one embodiment, button 2218 in FIG. 22 is provided to conveniently enable the player to remove all objects currently in the knapsack and start anew.

The award criterion for this knapsack game may be attainment of a previously calculated total value for the objects that is known to be optimal, attainment of at least a previously calculated near-optimal total value for the objects, or attainment of a total value for the objects that is better than that submitted by any other player. In one embodiment, the objects are arranged so that the prize equals the value of the objects in winner's knapsack.

The discovery of an optimal set of objects to be inserted into the knapsack is, in general, unobvious and requires skill in numerical judgment and manipulation. Although a knapsack problem with six objects (as shown in FIG. 22) may be relatively easy to solve, the problem becomes very difficult for larger numbers of objects. In the knapsack problem, the number of possible ways of inserting objects in to the knapsack (without exceeding the maximum weight) is larger than that which can be evaluated mechanically on a computer in any reasonable amount of time (particularly in relation to the limited amount of time that the player is given to play the skill game).

To reiterate, the processing logic discussed herein may comprise hardware, software or a combination of both.

In one embodiment, the skill game is a video game based in which the player may take a series of actions at various times and accumulate a score based on the skillfulness of his chosen actions. In one particular embodiment, the video game is pinball. In the game of pinball, the player is in control of a limited number of control mechanisms (e.g., releasing a new ball and moving the flippers). A game such as pinball may be implemented as a computer game in which the game is entirely deterministic (i.e., contains no random or chance events). For example, the player selects the tension for releasing the ball. Once the player selects a particular tension, the ball starts moving in accordance with entirely deterministic equations of motion. As the ball moves across the playing field, entirely deterministic equations of motion determine the next state of the ball (e.g., its position and velocity). Similarly, as the ball hits various objects in the playing field, additional entirely deterministic equations of motion determine the next state of the ball in accordance with the characteristics of the object (e.g., the ball bounces off rubbery objects differently than solid surfaces). The player additionally has control of the flippers (and possibly additional-control mechanisms). As the ball interacts with a flipper, additional entirely deterministic equations of motion determine the next state of the ball in accordance with the exact force applied to the ball by the flipper at the moment of impact. Thus, if the player's inputs to the control mechanisms were exactly identical on multiple plays of the game, the trajectory of the ball (and the total score accumulated during the play of the game) would be identical. A more skillful player of the game will accumulate a larger total score. Chance plays no role in the total score that is accumulated. Such an entirely deterministic version of the game pinball is a game of pure skill.

For a skill game that ends after a specified amount of time, the player may acquire the official time governing the game (as maintained by the operator) by clicking on an icon.

It should be noted that the date and time maintained by the time-keeping mechanism on the player's computer may differ from the official date and time at the operator's site. This discrepancy typically amounts to many seconds or a minute or so. However, this discrepancy may be large (e.g., the time-keeping mechanism on the player's computer may not be correctly considering daylight savings time and therefore be incorrect by an hour).

In one embodiment, an alarm clock application can be downloaded into the player's computer. Such alarm clock application is based on the time-keeping clock in the player's computer. In one embodiment, the alarm clock application displays the official time when the game started (as provided by the operator of the skill game at the time of downloading), the official time when the game is to end (as provided by the operator of the skill game at the time of downloading), the time on the player's computer when the alarm clock application started (obtained from the player's computer at the time of downloading), the current time according to the player's computer (obtained from the player's computer by repeated interrogation of the clock on the player's computer), and the time remaining to play. The alarm clock application executes on the player's computer. It reports the current time and the time remaining (both according to the clock mechanism of the player's computer). The time remaining is computed by taking the difference between the current time (from the player's computer) and the time when the alarm clock application started (obtained from the player's computer at the time of downloading). The alarm clock application can present a visual alert on the player's screen (and an audio alert, if an audio facility is available on the player's computer) when the time (according to the player's computer) is within a specified amount of time (e.g., one minute) of the end of the game. Because of the potential for slight discrepancies between the time mechanism on the player's computer and the official time maintained by the operator, the interval for the alarm should be considerable (e.g., one minute). The rules of each skill game specify that the official time as maintained by the operator of the site governs the game.

If the award criteria of a particular game includes the speed of the player's response, a time measuring application is, in one embodiment, downloaded onto the player's computer along with the skill game. This time measuring application executes on the player's computer and records the time on the player's computer of when the time measuring application starts (obtained by accessing the time-keeping mechanism on the player's computer at the time of downloading) and the time when the player submits his response to the operator of the skill game (obtained by accessing the time-keeping mechanism on the player's computer at the time of submission). The time measuring application reports these two times to the operator of the skill game at the time of submission. In one embodiment, this information is encrypted by the time-measuring application on the player's computer prior to transmission to the operator of the skill game and then decrypted by the operator of the skill game upon receipt at the operator's site. In one embodiment, the operator of the skill game calculates the difference in the two times recorded and reported by the time-measuring application to determine the speed of the player's response. In an alternative embodiment, the operator of the skill game uses the actual time of arrival of the player's submission at the operator's site in determining the speed of the player's response. In yet another embodiment, the operator defers to the difference in the two times recorded and reported by the time-measuring application provided that it is close to the difference as recorded at the operator's site. The rules of each skill game specify which of these alternative approaches is used on a particular skill game.

Optimal operation of the site of the skill game requires that the operator of the site balance several competing considerations. These considerations include, but are not limited to, the following four items.

First, it is desirable to offer potential players a wide choice of skill games and, in particular, a wide choice of distinctly different types of skill games. Some players may prefer skill games involving word skill; others may prefer manipulative games involving visualization skills (such as the jigsaw puzzle game of FIGS. 16 and 17); and yet others may prefer skill games involving some numerical skills (such as the knapsack game of FIG. 22). Among potential players preferring word games, some may prefer a skill game such as the president's game (FIG. 3) involving historical knowledge; others may prefer the format of a crossword puzzle (FIGS. 6 and 7); and yet others may prefer a letter reallocation game involving word skills (FIGS. 8 and 9).

Second, it is desirable that a player desiring to play a particular skill game be able to start playing the game as soon as possible. Generally, a single instance of a skill game is presented to multiple players. Moreover, in one embodiment described previously herein, all players receive the skill game at the same time. Thus, a player's participation does not begin until the simultaneous beginning of the skill game for all players of that particular instance of the skill game. Therefore, to the extent that players are provided with a wide choice of skill games and to the extent that multiple players play each skill game, these first two considerations conflict with one another.

Third, the number of players participating in a particular skill game affects the size of the prize that may be prudently offered by the operator for winning that particular skill game. Broadly speaking, a larger prize is associated with a greater number of players playing a particular skill game (or instance thereof). However, offering multiple distinctly different skill games, with each game starting as quickly as possible, divides the number of potential players available to play any particular skill game at any particular time. Thus, this consideration is in contention with both the goal of offering a wide variety of skill games and the goal of starting each game with as small a delay as possible.

Fourth, although the number of winners in a skill game cannot be precisely computed using mathematical principles (as is the case, for example, in a game of chance, such as roulette), the operator's estimate of the number of winners in a particular skill game is, in general, more uncertain if fewer players are playing a particular skill game (or instance thereof).

In one embodiment, a new instance of a skill game is offered to players as soon as a threshold number of players request the game. In one embodiment, this threshold is relatively low (perhaps as low as two). A low threshold maximizes the goals of offering a wide variety of skill games and the goal of starting each game with as small a delay as possible. If the operator of the site has previously computed accurate estimates of the likely number of winners of each instance of each skill game, the prize that is offered for winning may be larger than that first suggested by the low threshold number of players needed to launch the game. Thus, the first three considerations can be attained to some degree at the expense of the fourth.

In one embodiment, after the player successfully logs on to his account, the player is presented with a menu offering a choice of skill games.

FIG. 23 shows an illustrative menu 2300 for four skill games, namely the First Name Game (described previously in connection with FIG. 13), the Crossword Geography game (described previously in connection with FIGS. 6 and 7), the Bin Packing game (described previously in connection with FIG. 19), and the Traveling Salesman game (described previously in connection with FIGS. 14 and 15). The menu includes, in one embodiment, such characteristics as the name of the skill game 2320 (FIG. 23), the price for playing the skill game 2330, the prize available for winning 2340, the duration of the skill game 2370, and the number of previous winners 2380.

In one embodiment, if the player clicks on "Rules" (FIG. 23) for any skill game, additional information is provided concerning how to play the game, the award criteria, and the detailed rules of the game. For example, if the player clicks on "Rules" 2351, additional information is provided concerning how to play the First Name game, the award criteria for the First Name game, and the detailed rules of the First Name game. If the player clicks on the clickable area labeled "Sample" (FIG. 23) for any game, a practice instance of the game is provided. For example, if the player clicks on "Sample" 2361, a practice instance of the First Name game is provided. If the player clicks on the number of previous winners, detailed information about the number of players and the number of winners of each possible prize level is provided. For example, if the player clicks on "1,234 winners" 2381, detailed information about the number of players and the number of winners of each possible prize level is provided for the First Name game.

In one embodiment, the menu also shows the number of potential players 2390 currently waiting to play the game and the minimum (threshold) number 2395 of players needed to launch the game. The presentation of the number of waiting players and the threshold is advantageous because it enables a player, if he so desires, to reduce the amount of time that the player will wait for the start of a game.

In one embodiment, the menu highlights visually any game for which the difference between the minimum number of players needed to launch a skill game and the number of players waiting to play the skill game is exactly one. This highlighting is advantageous because it enables a player, if he so desires, to instantly start playing a game. In one embodiment, this highlighting is accomplished by a flashing icon.

The menu also provides a mechanism (shown in the embodiment presented in FIG. 23 as boxes such as 2311, 2312, 2313, and 2314, but which may also be implemented, in another embodiment, as clickable symbols or clickable icons) for a player to indicate that he desires to play one or more games. For example, if the player desires to play the Traveling Salesman game, he would click on the box 2314 associated with that game. In the figure, one other player is already waiting to play the Traveling Salesman game (as shown at the point labeled 2394 in FIG. 23). If the minimum (threshold) number of players needed to launch the game is two players (as shown at the point labeled 2399 in FIG. 23), an instance of the Traveling Salesman game is launched and simultaneously provided to both the present player and the one waiting player. Both players then have 10 minutes to submit a solution to the Traveling Salesman game (as shown at 2374 of FIG. 23). The menu would then be updated, by processing logic, to reflect the fact the no players are currently waiting to play that game (at 2394).

If the player desires to play either the Crossword game or the Bin Packing game, he could click on boxes 2312 and 2313, respectively, in FIG. 23. In FIG. 23, no players are currently waiting to play those games (as shown by the points 2392 and 2393, respectively, in FIG. 23). Thus, a player expressing a willingness to play either of these two games will encounter some amount of delay before playing either of the game.

In one embodiment, the menu of the available games is presented in order of the number of additional players required to launch the game. For example, in this embodiment, the First Name game and the Traveling Salesman game would be presented first on the menu (because they each require only one additional player to launch the game) while the Crossword game and Bin Packing game would be presented later on the menu (because they each require two additional players to launch the game). This order of presentation makes it easier for a player to select games which will start sooner.

Two players is an advantageous minimum number of players for launching an instance of a skill game in terms of providing competition, reducing, and potentially minimizing, the amount of time that a player is likely to wait for game(s) of his choice, and increasing, and potentially maximizing, the number of different skill games that may be simultaneously offered to players by the operator of the skill games.

The ability of the operator of the skill games to satisfy the competing goals of offering reasonably sized prizes, reducing, or even minimizing, the amount of time that a player is likely to wait for a skill game of his choice, and increasing, or even maximizing, the number of different skill games that are simultaneously offered may be enhanced by arranging the available skill games into a hierarchy of skill games.

Such a hierarchical arrangement of skill games has at least two levels. There is at least one skill game at each level of the hierarchy. In the hierarchy, funds associated with a skill game at one level of the hierarchy contribute to at least one prize that is offered by at least one skill game at a higher level of the hierarchy. In one embodiment, the contributed funds are a designated portion of the consideration paid by players of a skill game at a lower level of the hierarchy. In an alternative embodiment, the contributed funds are based on the value of prizes that are not awarded in skill games from a lower level of the hierarchy (because no player satisfied the award criteria for a particular prize during the play of that skill game). Thus, as play proceeds on the skill games at the lower levels of the hierarchy, contributions of one or both types are made towards the prizes offered by the skill games at the higher levels.

FIG. 24 shows a menu 2400 containing seven skill games (each of which has been previously described herein). The menu includes information about each of the skill games. For example, for the first of the seven skill games shown in the menu of FIG. 24, the menu specifies that the name 2421 of the skill game is the Decades Game, the consideration 2431 for playing the game is $1, the prize 2441 available for winning is $2, the duration 2471 of the game is 5 minutes, the number 2479 of previous winners is 2,344, the number 2481 of potential players currently waiting to play the game is 1, and the minimum (threshold) number 2491 of players needed to launch the game is 3. The menu of FIG. 24 is similar to the menu of FIG. 23 in that it also provides access to the rules of the game and provides access to a sample game.

The seven skill games of FIG. 24 are arranged in an illustrative hierarchy of three levels. The first four skill games (namely the Decades Game 2421, the Presidents Game 2422, the Knapsack Game 2423, and the Hamiltonian Path Game 2424) are in the lowest level of the hierarchy. The fifth and sixth skill games (namely the Months Game 2425 and the Traveling Salesman Game 2426) are in the middle level of the hierarchy. The seventh skill game (namely the States Game 2427) is at the highest level of the hierarchy. For purposes of illustration in FIG. 24, the three levels of the hierarchy are visually divided (with the lowest level being labeled 2401, the middle level being labeled 2405, and the highest level being labeled 2407); however, in practice, the three levels need not be separated in this way.

The operation of the hierarchy of skill games can be understood from an example.

First, suppose the consideration (price) of the Decades Game 2421 (FIG. 24) on the lowest level of the hierarchy is $1 (at 2431), that there is only one prize level offered in the game, and that the single available prize is $2 (at 2441). Suppose that the minimum (threshold) number of players needed to launch the Decades Game 2421 is 3 (at 2491), that an instance of the game is actually launched with three players (so that the total revenue is $3), and that one player actually wins the available prize of $2. In this example, assume that 70 cents of the total revenue for playing this skill game at the lowest level of the hierarchy is then allocated as a contribution for a skill game at the middle level of the hierarchy (namely the Months Game 2425). In one embodiment, the allocation is made to a skill game in the middle level that is of the same general type (i.e., a word response game) as the game at the lowest level.

Second, suppose the price for the Presidents Game 2422 (FIG. 24) on the lowest level of the hierarchy is $2 (at 2432), that there is only one prize level in the game, and that the single available prize is $5 (at 2442). Suppose that the minimum number of players needed to launch the Presidents Game 2422 is 3 (at 2492), that an instance of the game is in fact launched with three players (so that the total revenue is $6), and that one player wins the prize of $5. Again, assume that 70 cents of the total revenue for playing this skill game is allocated as a contribution for a skill game of the same general type (i.e., a word response game) in the middle level of the hierarchy (namely the Months Game 2425).

Third, suppose that the same contribution of 70 cents is also made available by the Knapsack Game 2423 and the Hamiltonian Path Game 2424 as a contribution for a skill game of the same general type (i.e., a mathematical game), namely the Traveling Salesman Game 2426, in the middle level of the hierarchy.

Thus, in the above example, all four skill games at the lowest level of the hierarchy contribute 70 cents toward a game at the middle level of the hierarchy. The result of these contributions is, in one embodiment, that the prize available in the two skill games in the middle level of the hierarchy may be larger ($10 at 2445 and 2446 in FIG. 24) than the prizes available in the four skill games in the lowest level ($2 at 2441 and 2443 and $5 at 2442 and 2444).

In one embodiment, the funds that are contributed to a skill game at a higher level of the hierarchy are based on the value of prizes that are not awarded at a lower level of the hierarchy.

In one embodiment, when a skill game at a higher level of the hierarchy is launched, players of the contributing skill game at the lower level are given a free play. In one embodiment, the only players in the skill game at the higher level are the previous players from the lower level. In another embodiment, the previous players from the lower level join in with paying new players at the higher level. In yet another embodiment, only paying players participate in the skill game at the higher level.

When the time of launch of a game (in particular a game at a higher level of the hierarchy) is not imminent, it is advantageous for the operator of the skill games to announce the deferral of the start of the game. In one embodiment, this information is directly presented on the menu (e.g., as shown at 2485 of FIG. 24). In another embodiment, players are informed of the starting time of a future game by e-mail as soon as the starting time is known to the operator of the skill games. This approach is especially appropriate if the starting time of the future game occurs at a considerable time in the future so that minor differences in the time of actual receipt or actual opening of the e-mail message are not a major consideration. In both of the foregoing embodiments, the player may then visit the site of the skill games at the announced starting time in order to obtain the skill game.

In yet other embodiment, the skill game may be provided to eligible players by e-mail. This approach is especially appropriate if the skill game has a lengthy duration of play (e.g., 24 hours at 2477 of FIG. 24) so that minor differences in the time of actual receipt or actual opening of the e-mail message are not a major consideration.

It is advantageous to offer games offering a variety of different prize levels (e.g., $2 at 2441 and 2443, $5 at 2442 and 2444, and $10 at 2445 and 2446, and $25 at 2447 in FIG. 24). It is also advantageous to offer games of various lengths (e.g., 5 minutes at 2471, 10 minutes at 2475, and 24 hours at 2477). In addition, it is advantageous to offer games at different prices ($1 at 2431 and 2433 and $2 at 2432 and 2434). In one embodiment, the higher priced skill games are more difficult. In one embodiment, the higher priced skill games have a greater duration. In one embodiment, the higher priced skill games offer higher prizes.

The specific numerical values used in the above example are for the purpose of illustrating one possible embodiment involving variations in price, duration, prize, and methods for distributing funds within the hierarchy. The present invention is not intended to be limited to these particular numerical values. Numerous alternative numerical values and combinations of numerical values are possible.

Skill Games with Video Clues

In certain of the skill games described herein, the player is presented with one or more queries and is called upon to make a correct response to each query. The player may be called up to make responses by choosing among explicitly provided alternatives or to make responses that require the player to think up the correct response.

The queries may be in one of several forms, including complete sentences (e.g. "When did the Titanic sink?"), in hints (i.e., short phrases in the style commonly used in crossword puzzles), or a goal for the game (e.g., "Rearrange the given letters into a word" or "Make as many words as you can out of the given letters").

Such skill games may be implemented in several different formats, including, but not limited, to the formats described below.

Figure 25:
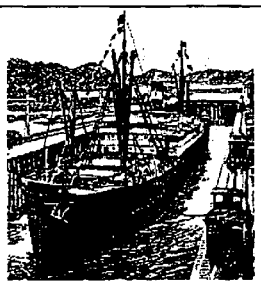
FIG. 25 illustrates one embodiment of a trivia game with one four-alternative query.

In a first format, the player is presented a one query and several alternative responses to the query. FIG. 25 shows a trivia game 2500 with single query 2510 and four alternative responses (2511, 2512, 2513, and 2514). This game is referred to as "flashcard trivia" since there is only one query presented to the player at a given time. Note that variations of this game may include more or less than four alternative responses. In FIG. 25, the single query 2510 (i.e., "First president to travel outside the United States while in office") is in the form of a hint. In an another embodiment, the query is presented in the form of a complete sentence (e.g., a direct question). The player responds by choosing one of the given alternatives. In one embodiment, the game bears a unique perpetual identifying number 2501 and the player sees a count-down clock 2502 that indicates the amount of time remaining to play. The player may submit his responses by explicitly clicking on the button 2530 labeled "submit." In one embodiment, the game is constructed so as to automatically submit whatever responses the player has made when the time 2502 runs out.

One form of this basic skill game (and each of the other skill games described below) may be played in a manner that uses only text (e.g., words, letters, spaces). However, players are likely to rapidly lose interest in games involving only text, especially if the player plays a sequence of such games in rapid succession. This skill game (and each of the other skill games described below) can be improved by the addition of visual, audio, or olfactory stimulation (or a combination of two or three such types of stimulation). In one embodiment, the visual, audio, or olfactory stimulation is an integral part of the game. In an alternative embodiment, the visual, audio, or olfactory stimulation assists the player in playing the game by providing a helpful clue to suggest the correct response.

The trivia game 2500 of FIG. 25 asking for the "first president to travel outside the United States while in office" can be enhanced by adding a picture 2505 of the Panama Canal. Theodore Roosevelt 2512 left the United States while president to visit the canal while it was under construction. This visual image of the Panama Canal provides a potentially helpful clue in enabling the player to identify the correct answer in this skill game. The clue contained in the image is helpful because Theodore Roosevelt is closely identified with the Panama Canal.

The picture of the picture 2505 of the Panama Canal might be embodied as a photograph, a painting, a drawing, the image of a postage stamp depicting the canal, the image from a banknote depicting the canal, a picture of a coin depicting the canal, a static cartoon image, an animated cartoon image, an animated video segment showing a ship moving through the Panama Canal, a flag, any other visual image of any type suggestive of the Panama Canal, or any other visual image of any type suggestive of the Theodore Roosevelt (e.g., a Teddy bear).

Inclusion of the visual image as part of a game employing network communications may be implemented using any of several techniques that are well known in the prior art, including, but not limited to, GIF and JPEG.

In this example, the clue contained in the visual image is not required to correctly answer the question. The player may happen to know the answer to the question without the clue. In an alternative embodiment, the query and the image are constructed so that a clue contained in the visual image is necessary to answer the question. That is, the query asks about some aspect of the visual image itself.

In a second format, the player is presented with more than one query, each with more than one alternative response. FIG. 26 shows a "multi-question" trivia game 2600 with two queries in the form of hints (2610 and 2620) in which each query has four alternative responses. For example, the second query 2620 has four alternative responses (2621, 2622, 2623, and 2624). Alternative embodiments may have more or less responses. The player responds to each query by choosing one of the given alternatives.

The two-query trivia game 2600 of FIG. 26 can be enhanced by adding a picture 2605 of the 1939 United States postage stamp honoring the $100^{th}$ anniversary of baseball. In addition to making the presentation of this game more interesting visually, this particular image contains the dates 1839 and 1939 and thereby provides a potentially helpful clue in enabling the player to identify the correct answer to one of the two queries in this skill game. The clue contained in the postage stamp is helpful because the player may well know that Franklin Roosevelt 2621 was President in the late 1930's, while the player may not recall that the first baseball game was played in 1839.

In a third format, the player is presented with more than one query; however, there is a single group of alternative responses that is shared by all of the queries. FIG. 27 illustrates one embodiment of a trivia game 2700 in which there are two queries (2711 and 2712). There is a single group of eight alternative responses (2721 through 2728). This group of alternatives is shared by both of the queries 2711 and 2712. The player responds to each query by choosing one of the eight available alternatives (2721 through 2728). In one embodiment, none of the alternative responses is the correct answer to more than one query. That is, if there are two queries, the player responds by choosing two distinct alternatives from the eight available alternatives. This game is referred to herein as "lotto trivia" because the grid of shared available alternatives bears some resemblance to a lotto betting slip and because the player plays by choosing two of the eight alternatives.

The two-query trivia game 2700 having a single group of alternative responses shared by both queries in FIG. 27 can be enhanced by adding a picture 2705 of a front of a confederate banknote. The city of Richmond is mentioned in the wording on the face of the banknote. This visual image provides a potentially helpful clue in enabling the player to identify the correct answer to one of the two queries in this skill game. The player may not recall the location of the capital of the confederacy, but may be able to infer that the reference to Richmond on the banknote indicates that the capital must have been in Virginia 2728.

Figure 28:
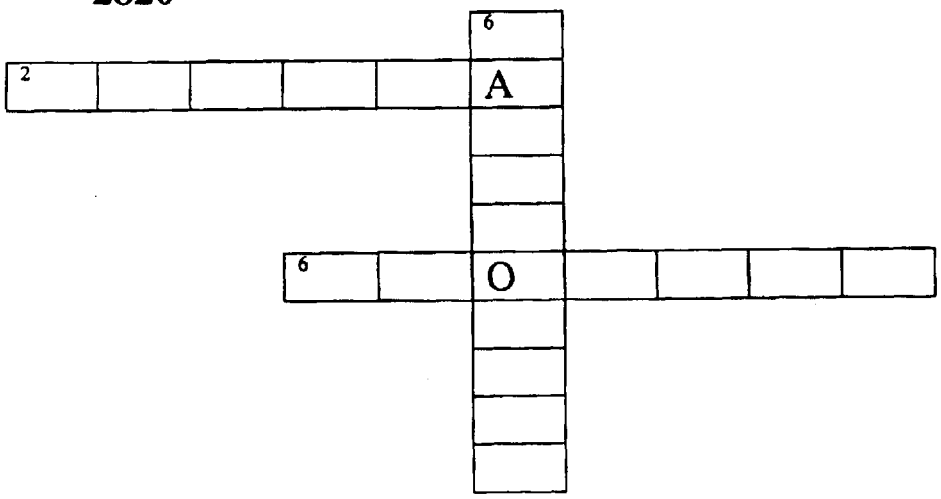
FIG. 28 illustrates one embodiment of a crossword game.

In a forth format, the player is presented with a arrangement of squares in the familiar style of a two-dimensional crossword puzzle. In this game, the player has to think up the responses (containing the specified number of letters) for himself. FIG. 28 illustrates one embodiment of a crossword-style game 2800 in which there is a two-dimensional arrangement 2820 and three queries (hints 2811, 2812, and 2813). The crossword style arrangement shows the number of letters in the correct response to each of the three queries. For example, the correct response to the "6-down" hint 2811 has 10 letters. The player responds to each query (hint) by entering letters into the squares of the crossword arrangement.

The three-hint crossword game 2800 can be enhanced by adding a picture 2805 of the skyline of Atlanta highlighting Georgia's gold-domed state capital. This visual image provides a potentially helpful clue (for the "6-across" hint 2813) in enabling the player to recall (or realize) that there was a gold rush in Georgia in the early 1800's and that this gold was then used in building the dome of the state capital. In one embodiment, the suggestive image is clearly associated with a particular query. In an alternative embodiment, the suggestive image may be presented in such a way as to not link it clearly with any particular query. In this example, the suggestive image is associated with the most difficult of the three queries (since the player is more likely to know about the California and Alaska gold rushes than the Georgia gold rush). In this example, the suggestive image is not specifically associated with one of the three hints (namely, 6-across).

In a fifth format, the player is presented with a goal ("Rearrange the given letters into a word") and spaces in which to enter a word. In this letter rearrangement game, the player has to think up the response(s) himself. FIG. 29 illustrates one embodiment of a game in which there are six given (jumbled) letters 2910 (H, T, T, O, R, and A) and there is a space 2920 in which to enter a six-letter word. The player responds by entering the six given (jumbled) letters 2910 into the space 2920 to spell a word (i.e., THROAT) in the space 2920. In an alternative embodiment, there may be more than one set of given letters, each with space in which to enter a word using all of the letters of the given letters of a particular set. For example, there may be two sets of five given letters and two additional sets of six given letters.

The letter rearrangement letter game 2900 can be enhanced by adding a close-up picture 2905 of an open mouth. This visual image provides a potentially helpful clue in suggesting the word THROAT to the player.

In a sixth format, the player is presented with a goal ("Make as many words as you can out of the given letters") and spaces in which to enter words. In this word construction game, the player has to think up the response(s) himself. FIG. 30 illustrates a game in which there are five given letters 3010 (M, E, A, T, and S) and there is space 3020 in which to numerous five-letter words can be entered. In one embodiment, the given letters form a word. In the figure, there is space for up to six five-letter words. The player responds by entering the five given letters on each line to spell a different word. Each word that the player enters is composed only of the five given letters. For example, the player might enter TEAMS on the first line and STEAM on the second line.

The word construction game 3000 can be enhanced by adding a close-up picture 3005 of a steam railroad locomotive. This visual image provides a potentially helpful clue in suggesting the word STEAM to the player as a word that can be created from the letters M, E, A, T, and S. The picture 3005 of the steam railroad locomotive might be embodied as a stock or bond certificate of a historical railroad company depicting a locomotive, a photograph of a steam locomotive, a painting, a drawing, a postage stamp, a banknote, a coin, a static cartoon image, an animated cartoon image, an animated video segment showing a steam railroad locomotive belching steam, or any other visual image of any type suggestive of steam railroad locomotive. Games such as those shown in FIGS. 28, 29, and 30 in which the player thinks up a response are generally more difficult to play than games where the player merely chooses among given alternative responses.

In a seventh format, the player is presented with more than one query, each with more than one alternative response. FIG. 31 illustrates one embodiment of a game referred to herein as "bin trivia" 3100. The game is presented with individual elements to be dragged and dropped into bins (categories). In this figure, there are the six individual elements. In the figure, the individual elements represent people, namely Franklin Piece 3111, Charles Bronson 3112, William Gates 3113, James Polk 3114, Scott Mc Neely 3215, and George Scott 3116. In FIG. 31, the three bins represent categories into which the individual elements (people) can be placed. The three bins (categories) in FIG. 31 are presidents 3131, famous movie stars 3141, and famous businessmen 3151. This game is referred to as "bin trivia" because the game involves placing each individual element (query) into one of a fixed number of distinct bins (categories).

The game of bin trivia requires that the player possess information that is similar in character to the information required to play the games of Flashcard Trivia (FIG. 25), multi-question trivia (FIG. 26), Lotto Trivia (FIG. 27), and crosswords (FIG. 28); however, this bin trivia game 3100 has a different mechanism of play.

The bin trivia game 3100 of FIG. 31 can be enhanced by adding a picture 3105 of the corporate logo of Sun Micro Systems. In addition to making the presentation of this game more interesting visually, this particular image may be helpful to the player because it may jog the player's mind into realizing that a possibly unfamiliar element that must be placed into one of the bins (Scott Mc Neely 3115) is the founder and head of Sun Micro Systems. The visual clue might be helpful to some players in successfully categorizing all six individual elements of this particular game.

The individual elements and the bins in the bin trivia game 3100 can represent numerous different things. For example, in one embodiment, there are four bins and the bins represent states of the United States (e.g., California, Illinois, Ohio, and New York). In this embodiment, the individual elements are any of the numerous possible individual elements that are associated with the states involved. For example, the individual elements may be capital cities, tourist attractions, telephone area codes located within the state, zip codes located within the state, universities located in the state, well-known companies that are headquartered in the state, national parks located within the state, interstate highways that pass through the state, geographic features (e.g., mountains, lakes, rivers) in the state, state flowers, state flags, state birds, presidents from the state, famous people from the state (e.g., inventors, movie stars, writers, artists), and three-letter codes of airports located in the state.

In another embodiment, the bins are countries.

In another embodiment, the bins are periods of time (including, but not limited to, centuries, decade periods, individual years, months of the year, zodiacal parts of the year, days of the week, weeks, or named periods of time, such as Biblical times, the Middle Ages, the Renaissance, and the Industrial Revolution). As before, there are numerous possible individual elements that can be associated with a particular period of time, including, but not limited to, inventions, discoveries, births or deaths of historical figures, famous battles, treaties, and creation of pieces of music, art, architecture, or engineering.

In another embodiment, the bins are famous people. As before, there are numerous possible individual elements that can be associated with a particular famous person, including, but not limited to, place of birth, achievements (e.g., books for writers, movies for movie stars, paintings for artists), year of birth, year of death, name of spouse (or children, siblings, or parents), or events associated with the person.

In an alternative embodiment, bin trivia comprises bins presented as multiple check-off boxes for each individual element.

In an eighth format, the player is presented with at least one query, each query having a possible response of either "true" or "false." FIG. 32 shows a true/false type of trivia game 3200 with one query. The player responds to the query by choosing either true 3211 or false 3212.

The true/false type of trivia game 3200 can also be enhanced by adding a visual image. In this eighth format (as for all the previous formats), the visual image may be decorative; it may provide a clue that is helpful to the player successfully responding to the query; or it may be a necessary and integral part of the query. In FIG. 32, the image is a satellite image of the Millennium Dome 3205 in London and this visual image is a necessary in order to respond to the query 3210.

Other formats are possible for presenting games in which the player is presented with one or more queries and is called upon to make a correct response to each query or to attempt to achieve a stated goal of the game. In one embodiment, more than one visual image is included in a particular game (e.g., there might be one visual image suggestive of the correct response to each query in a game with multiple queries).

Several specific types of visual clues provide the basis for especially appealing games.

There is considerable public interest in images of well-known sites from great heights. Recently, satellite images have become commercially available from several vendors, including Globexplorer (www.globexplorer.com). These commercially available images have sufficient resolution to permit the recognition of well-known sites, such as the White House in Washington, the Eifel Tower in Paris, and the Millennium Dome in London, the Pyramids, sports stadium facilities, dams, airports, bridges, the merging of major bodies of water, and broad views showing the sprawl of major cities with nearby natural features such as rivers, bays, lakes, oceans, islands, or mountains. Aerial images are also available showing well-known sites from directly above or at an angle.

Several different types of queries can be generated for a given satellite or aerial image. For example, in one embodiment, the query may require identifying the country, state or province, or city where the site is located. In this embodiment, the image is not merely a clue in helpful the player to respond to the query, but the image is a necessary and integral part of the query. In another embodiment, the query may require correctly identifying the name of the site. In one embodiment, the query may require the name that the name be identified from a list of alternatives that includes the correct response and at least one incorrect response (that is, in the format of the Flashcard Trivia game of FIG. 25 or the multi-question trivia game of FIG. 26). In another embodiment, a true/false query may be presented concerning the site's location or name (as is shown by the format shown in FIG. 32).

Images of cities taken nearer the ground (such as skyline images or street scenes taken at ground level) can also be used as the basis of constructing queries for skill games.

There is also nearly universal public interest in the prices of things, including, but not limited to, the prices of luxury goods, ordinary goods, real estate, or stocks. In one embodiment, queries may constructed concerning the price of a particular luxury item or ordinary item. Such prices may be based on the manufacturer's suggested retail price, the price contained in a widely distributed catalog (e.g., the famous Neiman Marcus Christmas catalog, real estate magazines featuring unusual houses such as Unique Homes), the prices of ordinary items that are advertised at a well-known web site (e.g., the prices on the web site at www.walmart.com), or the price actually received for a specified item on a specified date at a particular public auction (e.g., a physical auction, such as Christies, an on-line auction (e.g., www.ebay.com), or a financial auction, such as the stock exchange). There are numerous different queries that can be constructed concerning such prices. In one embodiment, the query involves identifying the correct price from a list that contains at least one incorrect price. In skill games involving prices, a visual image may, in one embodiment, be used as a helpful stimulus to aid the player in focusing on the response. In another embodiment, the visual image may be a necessary and integral part of the query (e.g., showing a picture of the house for which the player must estimate the price).

There is considerable public interest in maps. Several different types of queries can be generated from maps. Maps are available to different degrees of detail. For example, a portion of the map of a particular county can be shown and the query can involve the name of the state where the county is located, the name of some geographic feature found within the area of the map (e.g., a river, lake, mountain, bay, peninsula, or island), the name of the largest city outside of the immediate boundary of the map, and so forth.

There is also considerable public interest with relatively recent historical events. Images of front pages of newspapers, containing compelling headlines or visual images, may also be used as the basis of constructing queries for skill games.

One practical implementation of skill games with visual images using network communications requires that a careful balance be struck involving several competing factors. These factors include the size of the visual image (as measured in bytes), the communication bandwidth that the game player is likely to use to play the game using network communications, and the particular structure of the skill game.

Visual images (e.g., GIF, JPEG) of colorful scenes can often be adequately represented and stored with as few as 2,000 to 4,000 bytes. However, the same image is usually considerably more attractive if it is presented on the player's computer screen at greater resolution. For example, an order of magnitude increase in size (i.e., to 20,000 to 40,000 bytes), considerably improves the appearance of the visual image. Many players of the skill games using network communication described herein may (at least at the time of this writing) connect their computers to the internet by use of an ordinary telephone line and a relatively slow modem (e.g., 14 kilobit per second), an ordinary telephone line and an intermediate speed modem (e.g., 28 kilobits per second), or an ordinary telephone line and a faster modem (e.g., 56 kilobits per second). Other players may have higher-speed connections, such as Digital Subscriber Lines (DSL), cable modems, or T-1 lines.

Suppose visual images are accompanying queries in the Flashcard Trivia game (FIG. 25). A typical game of Flashcard Trivia might have eight queries. If this particular game is played with succinctly worded queries (involving, say, 12 or fewer words) and only a few alternative responses (say, four), the fastest players are able to read, assimilate, and respond to each such query within 4 seconds (while the average player takes about 10 seconds). To put these times in perspective, an image of, for example, 20,000 bytes takes 11 seconds to be transmitted to the player's computer if the player is using an ordinary telephone line and slow modem. Thus, an image of 20,000 bytes may take longer to be transmitted to fast or average players than the player will take to respond to the query.

It is generally considered highly desirable to eliminate (or at least minimize) waiting by players in connection with the playing of games on the internet. Suppose, for example, that three of the eight queries in a game of Flashcard Trivia are to contain visual images. Waits by the player (especially for a player employing an ordinary telephone line and slow modem) can be eliminated or minimized by not having any visual image whatsoever in connection with the first or second of the eight queries of the Flashcard Trivia game. During the time when the player is playing the first and second query, the visual image associated with the next query is transmitted and communicated using network communication from the operator of the game to the player's computer. This transmission occurs while the player is responding to the first and second query. This visual image is cached so that it is available when the player gets to the query that requires the visual image. Similarly, while the player is playing the early queries, the remaining visual image(s) are transmitted and communicated using network communication from the operator of the game to the player's computer. The result of this advance transmission and caching of all required visual images is the elimination or minimization of waiting by the player (especially for a player employing an ordinary telephone line and slow modem).

Visual clues may be used in several different ways. For example, a visual clue may be used to set the mood for the question; a visual clue may provide a clue that is helpful to the player responding to the query; or a visual clue may be a necessary and integral part of the query.

A visual clue may be used in a game, among others, of flashcard trivia (FIG. 25), multi-question trivia (FIG. 26), Lotto Trivia (FIG. 27), crosswords (FIG. 28), bin trivia (FIG. 31), or true/false trivia (FIG. 32).

Skill Games with Audio Clues

In an alternative embodiment, useful clues in the form of audio stimulation may be used in addition to, or in place of, visual stimulation. For example, the letter rearrangement letter game 2900 may be enhanced by adding the sound of a person gargling. This audio stimulation may provide a potentially helpful clue in suggesting the word THROAT to the player. Similarly, audio stimulation in the form of escaping steam (say, hissing out of a radiator) may be used to enhance the word construction game 3000 where the word STEAM is a correct response. This audio stimulation may be in addition to the visual image 3005 or in lieu of the visual image 3005.

Audio clues may be provided in several forms. In one form, the audio clue may be in the form of spoken words. The spoken words may be suggestive of the correct answer to the query. For example, the spoken words may a part of a famous phrase spoken by a famous person (e.g., "We have nothing to fear but fear itself" if the correct answer to a query is Franklin Roosevelt). In another form, the audio clue may be in the form vocal music (e.g., a portion of the "Yellow Rose of Texas" if the correct answer to a query is Texas). In yet another form, the audio may be in the form of instrumental music. In still another form, the audio may be in the form of a particular sound (e.g., hissing steam, clearing of a throat).

Inclusion of audio in a game that is to be delivered by use of network communication may be implemented using any of several techniques that are well known in the art.

In one embodiment, audio may be provided as a helpful clue to aid the player in thinking of the correct response. In another embodiment, the audio may be a necessary and integral part of the query. For example, suppose the goal of a game is to identify the speaker of the words "We have nothing to fear but fear itself." This type of audio-based query may be used in a game, among others, of Flashcard Trivia (FIG. 25), multi-question trivia (FIG. 26), Lotto Trivia (FIG. 27), crosswords (FIG. 28), bin trivia (FIG. 31), or true/false trivia (FIG. 32). Similarly, audio-based query may be used in a game whose goal is to identify a musical composition (e.g., from Beethoven's Fifth Symphony) from a few bars of music.

One practical implementation of skill games with audio segments using network communications requires that a careful balance be struck involving competing factors, such as the size of the audio segment (as measured in bytes), the communication bandwidth that the game player is likely to use to play the game, and the structure of the particular skill game. Suppose, for example, that two or three of the eight queries in a game of Flashcard Trivia are to contain audio segments (or perhaps a combination of visual images and audio segments). Possible waits by the player (especially for a player employing an ordinary telephone line and slow modem) can be eliminated or minimized by not having any audio segment (or visual image) in connection with the first one or two of the eight queries of the Flashcard Trivia game. During the time when the player is playing the first or second query, the audio segment (or visual image) associated with a later query (e.g., the third query) is transmitted and communicated using network communication from the operator of the game to the player's computer. This audio segment (or visual image) is cached so that it is available when the player gets to the query requiring the audio segment or visual image. Similarly, while the player is playing later queries of the game, the remaining audio segments (or visual images) are transmitted and communicated using network communication from the operator of the game to the player's computer.

Skill Games with Olfactory Clues

DigiScents Inc. of Oakland, Calif. (http://www.digiscents.com) has demonstrated the feasibility of technology for digitizing, transmitting, and synthesizing scent. The scent would be provided to the user of a personal computer by an apparatus, analogous to a printer for printing images on paper or a video screen for presenting images on a screen, that wafts odors in the general direction of the computer user's nose.

An olfactory clue may be used in several different ways in the context of a skill game. For example, an olfactory clue may be used to set the mood for the question; an olfactory clue may provide a clue that is helpful to the player responding to the query; or an olfactory clue may be a necessary and integral part of the query.

An olfactory clue may be used in a game, among others, of flashcard trivia (FIG. 25), multi-question trivia (FIG. 26), Lotto Trivia (FIG. 27), crosswords (FIG. 28), bin trivia (FIG. 31), or true/false trivia (FIG. 32).

Player-Initiated Clues

In the foregoing embodiments of games of various format in which visual, audio, or olfactory clues are provided as helpful in aiding the player to think of the correct response, these clues are unconditionally provided to the player. In an alternative embodiment (applicable to each of these types of clues and to various different game formats), the clue is concealed. The player may, at his option, expose the clue in exchange for a specified penalty to his score. For example, FIG. 33 shows a version of the Flashcard Trivia game 3300. There is one query 3310 ("First president to travel outside the United States while in office") and four-alternatives (3311, 3312, 3313, and 3314). The correct response to this query is stated to be worth 10 points. However, the player may expose the helpful clue 3305 (showing, for example, a picture suggestive of the correct answer, Teddy Roosevelt, namely the Panama Canal) by sacrificing 5 points (or a portion of a prize). Thus, if the player correctly answers this query without the helpful clue, he acquires 10 points; however, if he successfully answers the query with the clue, he acquires only 5 points. If the player incorrectly answers the query without the clue, he acquires 0 points. If the player incorrectly answers the query after seeing the clue, he has −5 points.

As discussed elsewhere herein, a tie-breaking procedure is used, in one embodiment, in conjunction with the games described herein. Time is often used as one element of the tie-breaking procedure. In an alternative embodiment, the helpful clue 3305 appears in the last few seconds (e.g., the last four seconds) of the maximum time 3308 allowed to respond to the query. In this embodiment, the player acquires the helpful clue merely by not answering the query until the last few seconds. The player's score is penalized by a specified amount by virtue of his waiting until the last few seconds and receiving the concealed clue. If a competing player answers the query before the last few seconds, he will have an advantage in scoring over the player who waited until the last few seconds in order to acquire the helpful clue.

Intersecting Letter Clues in Crossword Game

In yet another embodiment, useful clues may be provided in a form unique and peculiar to a particular type of game. For example, in the crossword-style game 2800, the two-dimensional arrangement shows that certain letters lie in common with two responses. In one embodiment, none of the letters are provided to the player. In an alternative embodiment, the letter at the intersection of a row and column (e.g., the "A" at the intersection of the 6-down word and the 2-across word) is provided to the player. Similarly, the first letter (or any other letter or letters) of the solution to the letter rearrangement letter game 2900 may be provided as a clue. Also, similarly, the first letter (or any other letter or letters) of one of the several solutions to the word construction game 3000 may be provided as a clue.

Scoring of Skill Games

In one embodiment, the skill games described herein are primarily scored based on the number of correct responses. In one embodiment, the score is the number of correct responses. This scoring procedure does not penalize incorrect responses. In another embodiment, the score is the number of correct responses minus a percentage (greater than zero and up to and including 100%) times the number of incorrect responses. This scoring procedure penalizes incorrect responses. Also, unless the percentage multiplier is 100%, it tends to produce a greater number of distinct different score values (thereby reducing the number of tied scores).

In another embodiment, the scoring procedure assigns a different number of points (worth) to at least one query in a game. In yet another embodiment, the scoring procedure assigns a different number of points (worth) to every query in a game.

For example, the three queries in the crosswords game in FIG. 28 are each be worth a different number of points. Specifically, the 6-across query is worth 10 points 2816; the 2-across query is worth 20 points 2817; and the 6-across query is worth 40 points 2818. In this example, the three different values of the points are all multiples (by 10) of powers of 2 (i.e., 1, 2, and 4). Assume, for sake of simplicity here, that only correct answers count. Because of the different point values for the queries, if two players get two correct answers by answering two different queries correctly, they will receive two different scores. That is, two players will achieve the exact same score only by correctly responding to the exact same queries. Other arrangements of number of points (worth) achieve the same result, including, but not limited to, multiples of powers of integers other than two.

In one embodiment, the point values may be assigned based on the apparent difficulty to each query. Points may be similarly assigned to the individual queries in various games, including, but not limited to, the games of FIGS. 26, 27, and 31.

The responses by each player are scored by a preestablished computational procedure and a winner is identified from the group (tournament) of players playing the game. Although the use of fractional penalties for incorrect answers (described above) and the assignment of differing number of points to each query (described above) are both helpful in reducing the possiblity of ties, the possiblity of tied scores remains.

There are numerous ways of dealing with such ties. In one embodiment, the prize is shared among the tied players. However, it is generally preferable to identify a single winner in a game so that one player receives the full value of the intended prize.

Accordingly, it is advantageous, in one embodiment, that each game have a decisive tie-breaking procedure. These procedures are described to the player in the detailed rules of the game. Moreover, it is desirable that a tie-breaking procedure be unobtrusively implemented without causing non-tied players to wait.

In one embodiment, time is used to break ties. The times of the final clicks on responses are recorded in fractions of a second and reported, along with the actual responses, to the site of the operator of the game by network communications. In one embodiment, a tie is first resolved in favor of the player who first responded correctly to the very first query. If the players remain tied, the tie is resolved in favor of the player who first responded correctly to the second query. This process continues through all the queries. Because the times are recorded in fractions of a second, this procedure will, in practice, resolve ties.

Performance-Based Tournament Formation

One important challenge in successfully constructing a "pay to play" prize-awarding game is to make the game attractive on a continuing basis to customers.

Games of chance (e.g., casino games and lotteries) address this challenge, in part, by offering certain (lower-valued) prizes at very favorable odds. Since winning is determined based on chance, virtually every regular player will frequently win these lower-valued prizes. Players thus receive the continuing reinforcement of regularly winning at least a modest prize.

Winning in a skill game is determined based on skill. Some players will necessarily prove to be better than others in playing a skill game. Thus, skill games have the potential problem that a less skillful player may never win any prizes at all. In particular, the less skillful player potentially may never receive the reinforcement of regularly winning at least a modest prize. Consequently, over a period of time, the less skillful player may lose interest in playing a skill game. This outcome is especially likely if the groups (tournaments) of players participating in a particular instance of a skill game are formed randomly and haphazardly. For example, suppose that the requisite number of players in an instance of a particular skill game is as small as 10. If the tournament of 10 players is formed on a first-come-first-served basis by including the first 10 players who happen to arrive at the gaming site and express a willingness to participate in the game, there will probably be at least one highly skilled player in every tournament of 10 players (along with less skillful players). The likely outcome, over time, will be that the least skillful players will rarely or never win even a modest prize.

In one embodiment, this potential problem can be alleviated by not forming the groups (tournaments) of players haphazardly. Instead, the groups (tournaments) of players are formed based on the skill level of the available players.

A player's level of skill at particular games can be inferred in several ways, including, but not limited to, measurement of past performance in playing a particular game (or similar type of game). In one embodiment, the player's skill level can be based on the percentage of previous games that the player won or lost. In another embodiment, the player's skill level can be based on the numerical score that he achieved in playing the game (regardless of whether the score entitled him to win). This latter approach is usually preferable since there is more information contained in a numerical score than the mere fact that the player won or lost.

In one embodiment, the measurement of a player's skill level is based on past performance in tournaments of several different sizes. In one embodiment, the player's skill level is measured by combining percentiles scores from tournaments of different sizes in which the player may have previously participated. For example, if the player's numerical score is the $10^{th}$ best among 100 players in a tournament of size 100 in one game (placing him in the $90^{th}$ percentile for this first game) and $8^{th}$ best among 10 players in a tournament size of 10 (placing him in the $80^{th}$ percentile for this second game), a combined score is computed based on his average percentile score (e.g., the $85^{th}$ percentile) for the two games. In one embodiment, the combined score may be weighted so that more recent scores are given greater weight than less recent scores. In one embodiment, a geometric series of weights may be applied.

The player's measured skill level may then be advantageously used to govern the process of forming the groups (tournaments) for playing a game. In one embodiment, more than one tournament group is simultaneously available to receive players for a particular game (e.g., a crosswords game). For example, four separate tournaments (each, say, of size 10) are kept open and available to receive players for the game. Players who have been identified as being in the top quartile of skill are placed into the first of the four tournaments. Similarly, players who have been identified as being in the remaining three quartiles of skill are placed into the appropriate one of the remaining three tournaments. Thus, the tournaments are formed based on the skill level of the players. The players assigned to each tournament play the game against each other. Players will tend to compete against similarly skillful players. Thus, players at each of the four skill levels will tend to be winners in the separate games.

The above-described skill-based approach for forming tournaments may be used in conjunction with various procedures for launching the games. In one embodiment, players do not start playing the game in their particular tournament until the full requisite number of players are recruited to play in that tournament. However, because the skill-based tournament formation requires making available multiple tournaments (one for each skill level), the delay might become a significant annoyance to players. If, for example, four separate tournaments of size 10 are available for four different levels of skills, it would take, on average, four times as much time to accumulate 10 players of each skill level. If there were a separate tournament for each decile of skill level, it would take, on average, 10 times as much time to accumulate the requisite number of players for each of the 10 decile levels of skill. The delay would be especially long and annoying if the overall level of sales is relatively small. For example, if players are arriving at the site and expressing a willingness to play at the rate of 1 every seconds, then the average delay might be an unacceptable 400 seconds to fully assemble four separate 10-player tournaments. On the other hand, if players are arriving at the site and expressing a willingness to play at the rate of 10 per second, then the average delay to fully assemble four separate 10-player tournaments might be a barely noticeable 4 seconds.

In any event, this potentially unacceptable delay in conjunction with skill-based tournament formation can be eliminated. In one embodiment, a player is permitted to start playing a particular game as soon as he expresses a willingness to play the game. In one embodiment, the player is afforded exactly the same maximum amount of time to play the game as other players with whom is competing in his tournament. The players belonging to a particular tournament then play the game out of synchrony with other players of their tournament. The outcome of the competition among the players is announced as soon as all the players of that particular tournament have completed their play. In one embodiment, a maximum time period is established over which such non-synchronized tournaments may be played.

Demographics-Based Tournament Formation

For certain games, such as trivia games and crossword games, where the play involves responding to queries (in the form of direct questions or hints), players with certain demographic characteristics are more likely to do well in responding to particular types of queries. For example, men are more likely than women to do well in answering questions about football. Women are not only less likely to do well in answering questions about football, but they may also come to feel that the game is not in tune with their interests. In a similar manner, older players are more likely than younger players to be able to respond correctly to queries involving events, movies, or music of the 1950's and 1960's. Similarly, younger players are not only less likely to do well in answering questions concerning events and popular culture of the 1950's and 1960's, but they may also come to feel that the game is not in tune with their interests. Likewise, players in Canada may be more familiar with Canadian geography, history, sports, and culture than with the geography of, say, the United States, Australia, or the United Kingdom.

It should be noted that the age of all players of the games described herein will be known to the operator of the games because players provide their birth date 130 (FIG. 1) as part of the process by which the player initially opens his account and establishes his eligibility to play. Moreover, identification of the player's sex may either be directly elicited from the player at the same time that the player opens his or her account or it may be inferred (in the vast majority of cases) from the player's first name. Moreover, the country in which a player is located will be known to the operator of the games because the player provides his name and address 110 (FIG. 1) at the time that he opens his account.

In one embodiment, the player's known demographic characteristics may be advantageously used to govern the process of forming the groups (tournaments) for playing a game. In one embodiment, more than one tournament group is simultaneously available to receive players for a particular game (e.g., a trivia game).

For example, in one embodiment, two separate tournaments (each, say, of size 10) may be kept open and available to receive players for the trivia game. Male players are placed into one of the two tournaments and female players are placed into the other. The players assigned to each tournament play the game against each other. Queries concerning football, for example, are then included among the queries presented to the tournament containing the male players, while these questions are not included among the queries presented to the female players. Within each separate tournament, the players of that tournament are presented with the same queries. The players of that tournament are given the same amount of time to respond to the queries. The players of each separate tournament compete among each other for the best score (as computed by the particular scoring procedure being used for that game).

Similarly, in another embodiment, players can be identified according to their age. In one embodiment, one age group contains players born between 1970 and 1979 (aged 21–30 in the year 2000). These "20-somethings" are, in one embodiment, the youngest permitted players in the games described herein. A second age group contains players born in the 1960s (aged 31–40 in 2000) (the "30-somethings"); a third age group contains players born in the 1950s (aged 41–50 in 2000); and a fourth age group contains older players. Players of each age group are placed into separate tournaments. The players assigned to each tournament play the game against each other. Queries are included or excluded based on the age group. For example, players in their 40's or older might be asked about a star of the movie Stage Coach (John Wayne) while players in their 20s might be asked about the star of a very recent movie.

A similar approach to tournament formation can be applied to the country in which the player is located.

The above-described demographics-based approach for forming tournaments may be used in conjunction with various procedures for launching the games. In one embodiment, players do not start playing the game in their particular tournament until the full requisite number of players are recruited to play in that tournament. However, because the demographics-based tournament formation requires making available multiple tournaments (one for each demographic group), the delay might become a significant annoyance to players. If, for example, two separate tournaments of size 10 are available for men and women, it would take, on average, twice as much time to accumulate 10 players of each sex. The delay would be especially long and annoying if the overall level of sales is relatively small. For example, if players are arriving at the site and expressing a willingness to play at the rate of 1 every 10 seconds, then the average delay might be an unacceptable 200 seconds to fully assemble two separate 10-player tournaments. On the other hand, if players are arriving at the site and expressing a willingness to play at the rate of 10 per second, then the average delay to fully assemble two separate 10-player tournaments might be a barely noticeable 2 seconds.

In any event, this potentially unacceptable delay in conjunction with demographics-based tournament formation can be eliminated. In one embodiment, a player is permitted to start playing a particular game as soon as he or she expresses a willingness to play the game. The player is afforded exactly the same maximum amount of time to play the game as other players with whom is competing in his or her tournament. The players belonging to a particular tournament then play the game out of synchrony with other players of their tournament. The outcome of the competition among the players is announced as soon as all the players of that particular tournament have completed their play. In one embodiment, a maximum time period is established over which such non-synchronized tournaments may be played.

Two or more different demographic characteristics can be combined in forming tournaments. For example, there might be eight separate. tournaments. The eight tournament represent the result of combining the previously described groups based on age and sex. As the number of tournaments proliferate in connection with demographics-based tournament formation, it becomes increasingly necessarily to minimize delays by such means as permitting a player to start playing a particular game as soon as he or she expresses a willingness to play the game. As above, in one embodiment, a maximum time period is established over which such non-synchronized tournaments may be played.

An Exemplary Network

Figure 20:
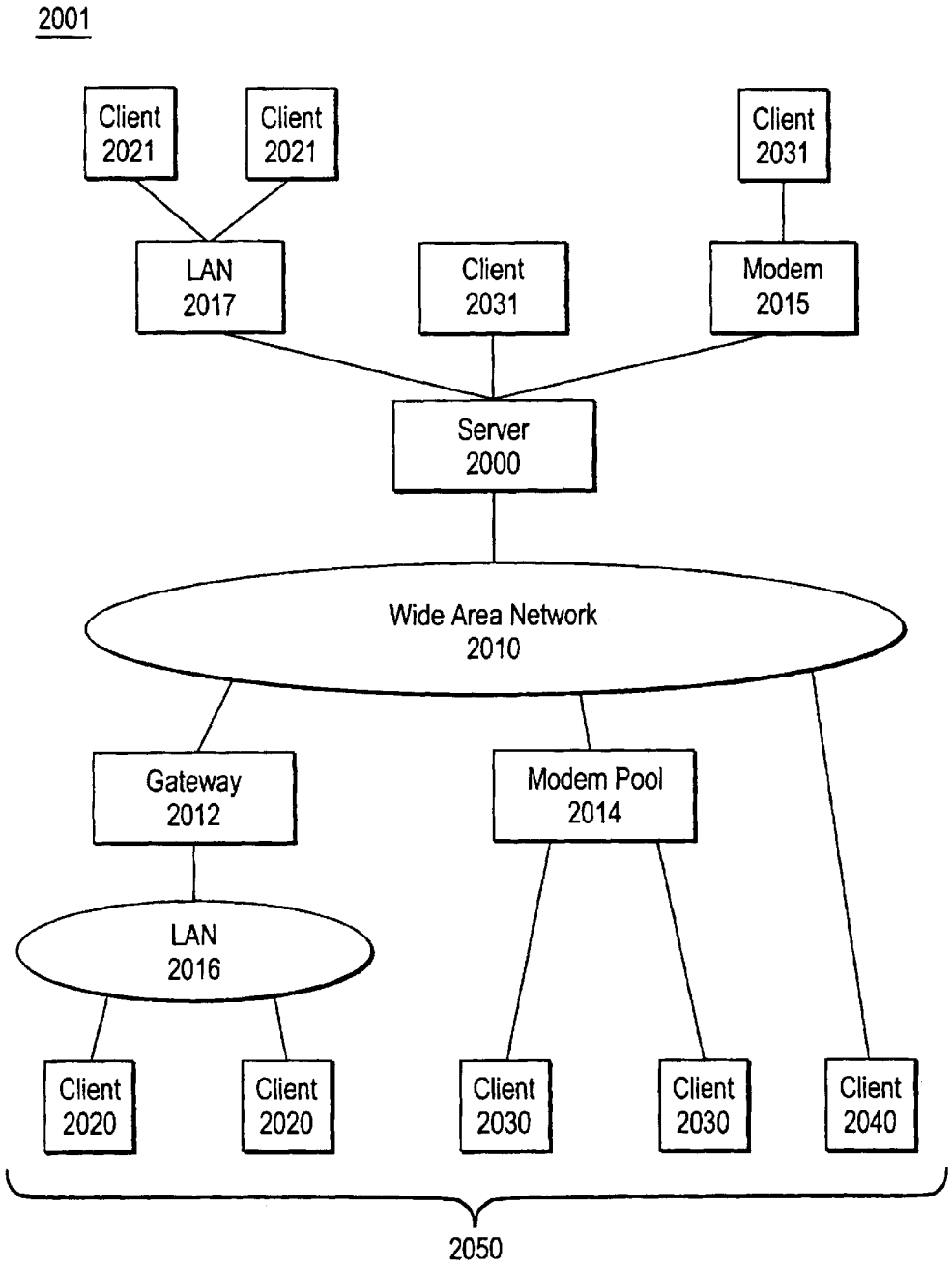
FIG. 20 is a block diagram of one embodiment of a network environment.

FIG. 20 is a block diagram of one embodiment of a network environment 2001 for network communications that may be used in the transmission techniques described herein. In one embodiment, a server computer system 2000 is coupled to a wide-area network 2010. Wide-area network 2010 may include the Internet or other proprietary networks including, but not limited to, America On-Line™, CompuServe™, Microsoft Network™, and Prodigy™. Wide-area network 2010 may include conventional network-backbones, long-haul telephone lines, Internet and/or Intranet service providers, various levels of network routers, and other conventional mechanisms for routing data between computers. Using network protocols, server 2000 may communicate through wide-area network 2010 to client computer systems 2020, 2030, 2040, which are possibly connected through wide-area network 2010 in various ways or directly connected to server 2000. For example, client 2040 is connected directly to wide-area network 2010 through direct or dial-up telephone or other network transmission line.

Alternatively, clients 2030 may be connected through wide-area network 2010 using a modem pool 2014. Modem pool 2014 allows multiple client systems to connect with a smaller set of modems in modem pool 2014 for connection through wide-area network 2010. Clients 2031 may also be connected directly to server 2000 or be coupled to server through modem 2015. In another alternative network typology, wide-area network 2010 is connected to a gateway computer 2012. Gateway computer 2012 is used to route data to clients 2020 through a local area network 2016. In this manner, clients 2020 can communicate with each other through local area network (LAN) 2016 or with server 2000 through gateway 2012 and wide-area network 2010. Alternatively, LAN 2017 may be directly connected to server 2000 and clients 2021 may be connected through LAN 2017.

Using one of a variety of network connection mechanisms, server computer 2000 can communicate with client computers 2050. In one embodiment, a server computer 2000 may operate as a web server if the World-Wide Web ("WWW") portion of the Internet is used for wide area network 2010. Using the HTFP protocol and the HTML coding language, such a web server may communicate across the World-Wide Web with clients 2050. In this configuration, clients 2050 use a client application program known as a web browser such as the Netscape™ Navigator™, the Internet Explorer™, the user interface of America On-Line™, or the web browser or HTML translator of any other conventional supplier. Using such browsers and the World Wide Web, clients 2050 may access graphical and textual data or video, audio, or tactile data provided by the web server 2000.

An Exemplary Computer System

Figure 21:
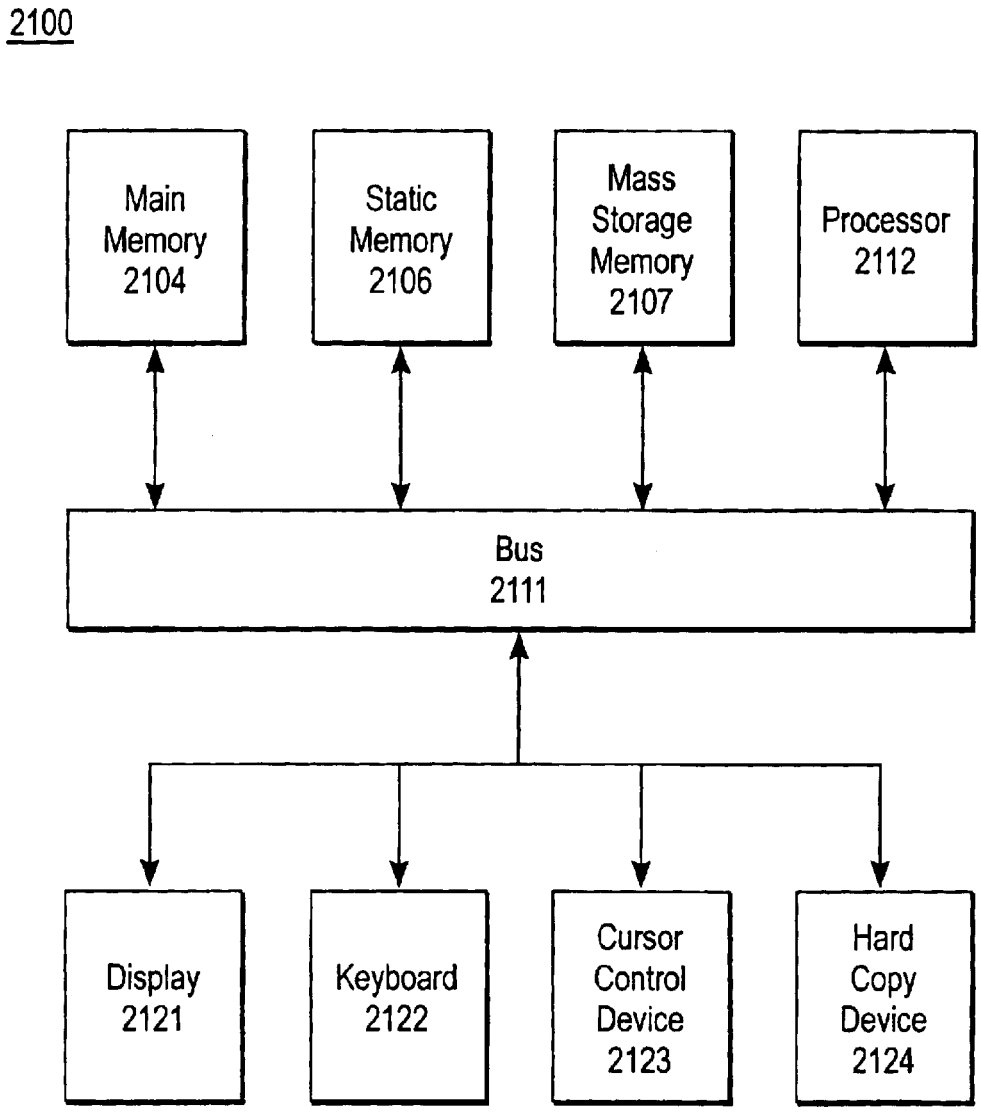
FIG. 21 is a block diagram of an exemplary computer system.

FIG. 21 is a block diagram of an exemplary computer system. Referring to FIG. 21, computer system 2100 may comprise an exemplary client 2050 or server 2000 computer system. Computer system 2100 comprises a communication mechanism or bus 2111 for communicating information, and a processor 2112 coupled with bus 2111 for processing information. Processor 2112 includes a microprocessor, but is not limited to a microprocessor, such as, for example, Pentium™, PowerPC™, Alpha™, etc.

System 2100 further comprises a random access memory (RAM), or other dynamic storage device 2104 (referred to as main memory) coupled to bus 2111 for storing information and instructions to be executed by processor 2112. Main memory 2104 also may be used for storing temporary variables or other intermediate information during execution of instructions by processor 2112.

Computer system 2100 also comprises a read only memory (ROM) and/or other static storage device 2106 coupled to bus 2111 for storing static information and instructions for processor 2112, and a data storage device 2107, such as a magnetic disk or optical disk and its corresponding disk drive. Data storage device 2107 is coupled to bus 2111 for storing information and instructions.

Computer system 2100 may further be coupled to a display device 2121, such as a cathode ray tube (CRT) or liquid crystal display (LCD), coupled to bus 2111 for displaying information to a computer user. An alphanumeric input device 2122, including alphanumeric and other keys, may also be coupled to bus 2111 for communicating information and command selections to processor 2112. An additional user input device is cursor control 2123, such as a mouse, trackball, trackpad, stylus, or cursor direction keys, coupled to bus 2111 for communicating direction information and command selections to processor 2112, and for controlling cursor movement on display 2121.

Another device which may be coupled to bus 2111 is hard copy device 2124, which may be used for printing instructions, data, or other information on a medium such as paper, film, or similar types of media. Furthermore, a sound recording and playback device, such as a speaker and/or microphone may optionally be coupled to bus 2111 for audio interfacing with computer system 2100. Note that any or all of the components of system 2100 and associated hardware may be used in the present invention. However, it can be appreciated that other configurations of the computer system may include some or all of the devices.

Several variations in the implementation of the present invention have been described. The specific arrangements and methods described here are illustrative of the principles of this invention. Numerous modifications in form and detail may be made by those skilled in the art without departing from the true spirit and scope of the invention. Although this invention has been shown in relation to a particular embodiment, it should not be considered so limited. Rather it is limited only by the appended claims.

We claim:

1. A method comprising:

establishing communication between a player of a skill game offering prizes and played for consideration and an operator of the skill game using network communications;

identifying geographic locations of at least one server or Internet service provider (ISP) through which the player communicates to the operator of the skill game;

determining whether the player is eligible, by virtue of location, and age, to play the skill game, wherein the eligibility of the player is determined, over the network communications, based in part on whether a jurisdiction associated with player's location allows the skill game to be played legally using the geographic location information of the server or ISP;

preventing the player from playing the skill game if the player is not eligible; and providing the player with the skill game using network communications, where the skills game includes a query to the player and a visual image that is integral to the query itself.

2. The method defined in claim 1 wherein the visual image comprises an image of a postage stamp.

3. The method defined in claim 1 wherein the visual image comprises an image of a photograph.

4. The method defined in claim 1 wherein the visual image comprises an image of a flag.

5. The method defined in claim 1 wherein the visual image comprises an image of a coin.

6. The method defined in claim 1 wherein the visual image comprises an image of a painting.

7. The method defined in claim 1 wherein the visual image comprises an image of a banknote.

8. The method defined in claim 1 wherein the visual image comprises a cartoon image.

9. The method defined in claim 1 wherein the visual image comprises a moving video image.

10. The method defined in claim 1 wherein the visual image comprises a satellite image of part of the earth.

11. The method defined in claim 1 wherein the visual image comprises an image of a skyline of a city.

12. The method defined in claim 1 wherein the visual image comprises an image of a street scene of a city.

13. The method defined in claim 1 wherein the visual image comprises a part of a map.

14. The method defined in claim 1 wherein the visual image comprises an image of at least a part of a newspaper page.

15. The method defined in claim 1 wherein the visual image comprises an animated cartoon image.

16. The method defined in claim 1 wherein the visual image comprises an item for sale and wherein said skill game involves the price of said item.

17. The method defined in claim 1 wherein a price is established by an auction.

18. A skill game defined in claim 1 wherein responses comprise words.

19. The method defined in claim 1 wherein the skill game comprises a plurality of queries and wherein a correct response to at least one of the plurality queries is worth a different number of points in determining a winner of the skill game than the correct response to another of said queries.

20. The method defined in claim 19 wherein the worth of each of the queries is arranged so a player can achieve the same total number of points as another player only if both players provide correct responses to the same queries among the plurality of queries.

21. The method defined in claim 1 wherein the skill game comprises at least one query with concealed clue information and wherein the player may optionally expose the concealed clue information in exchange for a penalty to a score used to determine an outcome of the skill game.

22. The method defined in claim 1 wherein the skill game comprises at least one element of concealed clue information, wherein the concealed clue information is automatically exposed to the player at a specified time before expiration of a time allowed to play the skill game, and wherein the player incurs a penalty to a score used to determine an outcome of the skill game as a result not having responded prior to said specified time.

23. The method defined in claim 1 wherein the skill game comprises tournaments of players playing the same game where said tournament is formed based on skill levels of players.

24. The method defined in claim 1 wherein the skill game comprises tournaments of players playing the same game where said tournament is formed based on at least one demographic characteristic of players.

25. The method defined in claim 24 wherein the at least one demographic characteristic is age.

26. The method defined in claim 25 wherein the at least one demographic characteristic is sex.

27. The method defined in claim 25 wherein the at least one demographic characteristic is the player's geographic location.

28. The method of claim 1, wherein the skill game includes multiple hierarchical levels, wherein when the skill game at a higher level of the hierarchy is launched, players of the skill game at a lower level receive a free play.

29. A method comprising:

establishing communication between a player of a skill game offering prizes and played for consideration and an operator of the skill game using network communications;

identifying geographic locations of at least one server or Internet service provider (ISP) through which the player communicates to the operator of the skill game determining whether the player is eligible, by virtue of location, and age, to play the skill game, wherein the eligibility of the player is determined, over the network communications, based in part on whether a jurisdiction associated with player's location allows the skill game to be played legally using geographic location information of the server or ISP;

preventing the player form playing the skill game if the player is not eligible; and providing the player with the skill game using network communications, along with clue information wherein the clue information is in audio form.

30. The method defined in claim 29 wherein the audio comprises spoken words.

31. The method defined in claim 30 wherein the skill game involves identifying a speaker.

32. The method defined in claim 29 wherein the audio comprises vocal music.

33. The method defined in claim 32 wherein the skill game involves identifying a singer.

34. The method defined in claim 29 wherein the audio comprises of instrumental music.

35. The method defined in claim 34 wherein the skill game involves identifying the musical composition.

36. The method of claim 29, wherein the skill game includes multiple hierarchical levels, wherein when a skill game at a higher level of the hierarchy is launched, players of the skill game at a lower level receive a free play.

37. An apparatus comprising:

means for establishing communication between a player of a skill game offering prizes and played for consideration and an operator of the skill game using network communications;

means for identifying geographic locations of at least one server or Internet service provider (ISP) through which the player communicates to the operator of the skill game;

means for determining whether the player is eligible, by virtue of location and age, to play the skill game, wherein the eligibility of the player is determined, over the network communications, based in part on whether a jurisdiction associated with player's location allows the skill game to be played legally using the geographic location information of the server or ISP;

means for preventing the player form playing the skill game if the player is not eligible; and means for providing the player with the skill game using network communications, where the skills game includes a query to the player and a visual image that is integral to the query itself.

38. A game comprising:

network communication means for enabling communication between a player of a skill game and an operator of the skill game;

means for identifying geographic locations of at least one server or Internet service provider (ISP) through which the player communicates to the operator of the skill game;

means for determining whether a potential player of the skill game is legally eligible, by virtue of location and age, to participate, wherein the eligibility of the player is determined, over the network communications, based in part on whether a jurisdiction associated with player's location allows the skill game to be played legally using the geographic location information of the server or ISP;

means for preventing the player from participating in the skill game in response to the first and second identification means determining that the player is ineligible;

means for receiving consideration from the player to operator of the skill game in exchange for the opportunity to participate in the skill game;

means for providing the player with a game where the skills game includes a query to the player and a visual image that is integral to the query itself, using the network communication means; and award criteria means for determining whether the player receives a prize, the award criteria being based on skill.

* * * * *